US009806410B2

(12) United States Patent
Tatarnikov et al.

(10) Patent No.: US 9,806,410 B2
(45) Date of Patent: Oct. 31, 2017

(54) FLAT SEMI-TRANSPARENT GROUND PLANE FOR REDUCING MULTIPATH RECEPTION AND ANTENNA SYSTEM

(71) Applicant: Topcon Positioning Systems, Inc., Livermore, CA (US)

(72) Inventors: Dmitry Tatarnikov, Moscow (RU); Kirill Klionovski, Krasnogorsk (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 563 days.

(21) Appl. No.: 14/150,919

(22) Filed: Jan. 9, 2014

(65) Prior Publication Data

US 2014/0125544 A1 May 8, 2014

Related U.S. Application Data

(62) Division of application No. 13/008,074, filed on Jan. 18, 2011, now Pat. No. 9,048,546.

(Continued)

(51) Int. Cl.
*H01Q 1/48* (2006.01)
*H01Q 15/00* (2006.01)

(52) U.S. Cl.
CPC ..... *H01Q 1/48* (2013.01); *H01Q 15/0013* (2013.01)

(58) Field of Classification Search
CPC ..... H01Q 1/48
See application file for complete search history.

(56) References Cited

U.S. PATENT DOCUMENTS 4,509,209 A * 4/1985 Itoh ..... H01Q 1/247 343/700 MS
6,501,427 B1 12/2002 Lilly et al.
(Continued)

FOREIGN PATENT DOCUMENTS

| | | | |
|---|---|---|---|
| JP | 2004032808 | A | 1/2004 |
| WO | 0173893 | A1 | 10/2001 |
| WO | 2008128582 | A1 | 10/2008 |

OTHER PUBLICATIONS

International Search Report and Written Opinion dated Jun. 20, 2011, for the corresponding international patent application No. PCT/IB2011/000073, 7 pp.

(Continued)

*Primary Examiner* — Trinh Dinh
(74) *Attorney, Agent, or Firm* — Chiesa Shahinian & Giantomasi PC

(57) ABSTRACT

Multipath reception by an antenna is reduced by mounting the antenna on a semi-transparent ground plane that has a controlled distribution of layer impedance over a central region and a peripheral region. The central region includes a continuous conductive segment on which the ground element of the antenna is disposed. The distribution of the layer impedance over the peripheral region is configured by multiple conductive segments electromagnetically coupled by lumped circuit elements. A semi-transparent ground plane can be fabricated by depositing a metal film on a dielectric substrate and etching grooves into the metal film to form a desired pattern of conductive segments. Lumped circuit elements can be fabricated as discrete devices, surface mount devices, and integrated circuit devices. Various semi-transparent ground planes can be configured for linearly-polarized and circularly-polarized radiation.

13 Claims, 31 Drawing Sheets

Related U.S. Application Data

(60) Provisional application No. 61/297,306, filed on Jan. 22, 2010.

(56) References Cited

U.S. PATENT DOCUMENTS

| | | | | |
|---|---|---|---|---|
| 6,756,857 | B2 * | 6/2004 | Aikawa | H03B 5/1817 331/177 V |
| 6,806,843 | B2 | 10/2004 | Killen et al. | |
| 7,187,337 | B2 * | 3/2007 | Aikawa | H01Q 13/103 343/700 MS |
| 7,319,430 | B2 | 1/2008 | Watanabe | |
| 7,463,213 | B2 | 12/2008 | Nakano et al. | |
| 9,048,546 | B2 * | 6/2015 | Tatarnikov | H01Q 1/48 343/700 MS |
| 2003/0169206 | A1 | 9/2003 | Egawa | |
| 2004/0263420 | A1 | 12/2004 | Werner et al. | |
| 2005/0200529 | A1 * | 9/2005 | Watanabe | H01Q 3/446 343/700 MS |
| 2005/0200530 | A1 | 9/2005 | Aikawa et al. | |
| 2007/0275318 | A1 | 11/2007 | Sugiura et al. | |
| 2008/0266179 | A1 | 10/2008 | Sotoudeh et al. | |
| 2014/0097995 | A1 | 4/2014 | McKinzie | |

OTHER PUBLICATIONS

Notice of Reason for Rejection dated Jun. 3, 2014, in connection with corresponding JP patent application No. 2012-549433, 4 pgs.

* cited by examiner

VIEW A

VIEW C

VIEW C

VIEW E

VIEW E

VIEW C

VIEW C

VIEW C

VIEW C

VIEW C

VIEW E

FLAT SEMI-TRANSPARENT GROUND PLANE FOR REDUCING MULTIPATH RECEPTION AND ANTENNA SYSTEM

This application is a divisional of prior U.S. patent application Ser. No. 13/008,074 filed Jan. 18, 2011, which claims the benefit of U.S. Provisional Patent Application No. 61/297,306 filed Jan. 22, 2010, both of which are incorporated herein by reference in their entirety.

BACKGROUND OF THE INVENTION

The present invention relates generally to antennas, and more particularly to flat semi-transparent ground planes for reducing multipath reception.

Multipath reception is a major source of positioning errors in global navigation satellite systems (GNSSs). Multipath reception refers to the reception by a navigation receiver of signal replicas caused by reflections from the complex environment in which navigation receivers are typically deployed. The signals received by the antenna in the navigation receiver are a combination of the line-of-sight (direct) signal and multipath signals reflected from the underlying ground surface and surrounding objects and obstacles. Reflected signals distort the amplitude and phase of the received signal. This signal degradation reduces system performance and reliability.

A parameter commonly used to characterize the multipath rejection capability of an antenna is the down/up ratio $$DU(\theta) = \frac{F(-\theta)}{F(\theta)},$$

where $F(\theta)$ is the antenna directional pattern level at an angle $\theta$ in the forward hemisphere and $F(-\theta)$ is the antenna directional pattern level at the mirror angle $-\theta$ in the backward hemisphere. In common practice, the angle $\theta$ is the elevation angle measured with respect to the horizon ($\theta=0°$ corresponds to the horizon, and $\theta=90°$ corresponds to the zenith). To estimate the multipath rejection capability of the antenna, values of $DU(\theta)$ over the range of approximately $30° \leq \theta \leq 90°$ are typically used. If the down/up ratio over this angular range is less than approximately −20 dB, the effects of multipath propagation are substantially reduced.

Multipath effects can be reduced by various antenna structures, such as a large, flat ground plane or a ground plane with a choke ring. These structures, however, increase the size and the weight of the antenna. Various other approaches have been developed. As one example, U.S. Pat. No. 6,100,855 discloses a ground plane fabricated from a radar absorbing material that suppresses surface currents on the ground plane and, consequently, reduces reflected signals. This design, however, does not reject multipath signals efficiently; the dimensions, particularly height, are still relatively large for navigation receivers. The radar absorbing material, furthermore, leads to a loss of active power (effective output) and a corresponding decrease in antenna gain.

What is needed is a ground plane with a high rejection of multipath signals, high antenna gain, and compact size.

BRIEF SUMMARY OF THE INVENTION

In an embodiment of the invention, multipath reception by an antenna is reduced by mounting the antenna on a semi-transparent ground plane with a controlled distribution of layer impedance. The semi-transparent ground plane includes an insulating layer having a surface with an outer perimeter and an inner perimeter. The surface of the insulating layer is partitioned into a central region within the inner perimeter and a peripheral region between the inner perimeter and the outer perimeter. A first conductive segment is disposed on the entirety of the central region. A second conductive segment is disposed on a first portion of the peripheral region and in electrical contact with the first conductive segment. A third conductive segment is disposed on a second portion of the peripheral region and spaced apart from the first conductive segment and from the second conductive segment. A lumped circuit element is electromagnetically coupled to the second conductive segment and to the third conductive segment. A lumped circuit element includes at least one resistor, capacitor, or inductor.

These and other advantages of the invention will be apparent to those of ordinary skill in the art by reference to the following detailed description and the accompanying drawings.

DETAILED DESCRIPTION

Figure 1A:
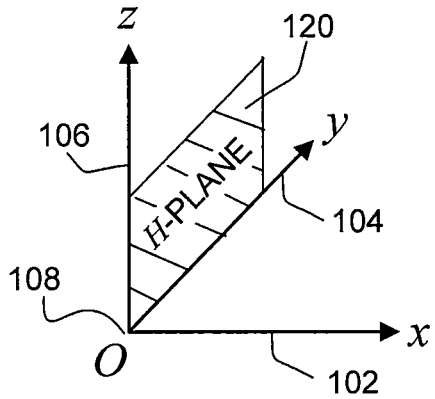
FIG. 1A-FIG. 1C show a reference Cartesian coordinate system for electric field planes and magnetic field planes.
Figure 1B:
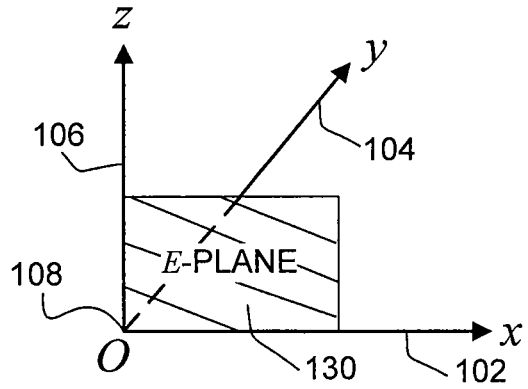

FIG. 1A and FIG. 1B show perspective views of a Cartesian coordinate system defined by the x-axis 102, y-axis 104, z-axis 106, and origin O 108. As shown in FIG. 1A, the magnetic field H-plane 120 lies in the y-z plane; as shown in FIG. 1B, the electric field E-plane 130 lies in the x-z plane.

Figure 1C:
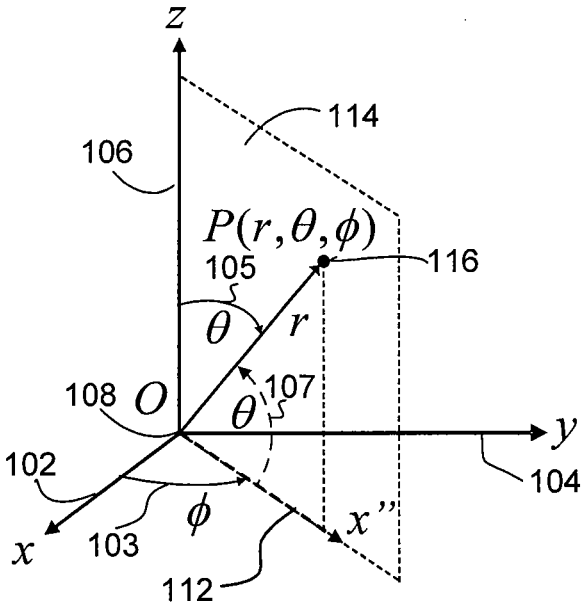

Geometric configurations are also described with respect to a spherical coordinate system, as shown in the perspective view of FIG. 1C. The spherical coordinates of a point P 116 are given by (r, θ, ϕ), where r is the radius measured from the origin O 108. Herein a point P has corresponding values of (r, θ, ϕ). The x-y plane is referred to as the azimuth plane; and ϕ 103, measured from the x-axis 102, is referred to as the azimuth angle. A plane defined by ϕ=constant and intersecting the z-axis 106 is referred to as a meridian plane. A general meridian plane 114, defined by the z-axis 106 and the x"-axis 112, is shown in FIG. 1C. The x-z plane and y-z plane are specific instances of meridian planes. In some conventions, the angle θ referred to as the meridian angle, is measured from the z-axis 106 (denoted θ 105). In other conventions, as used herein, the angle θ is measured from the x"-axis 112 (denoted θ 107) and is also referred to as the elevation angle.

Figure 1D:
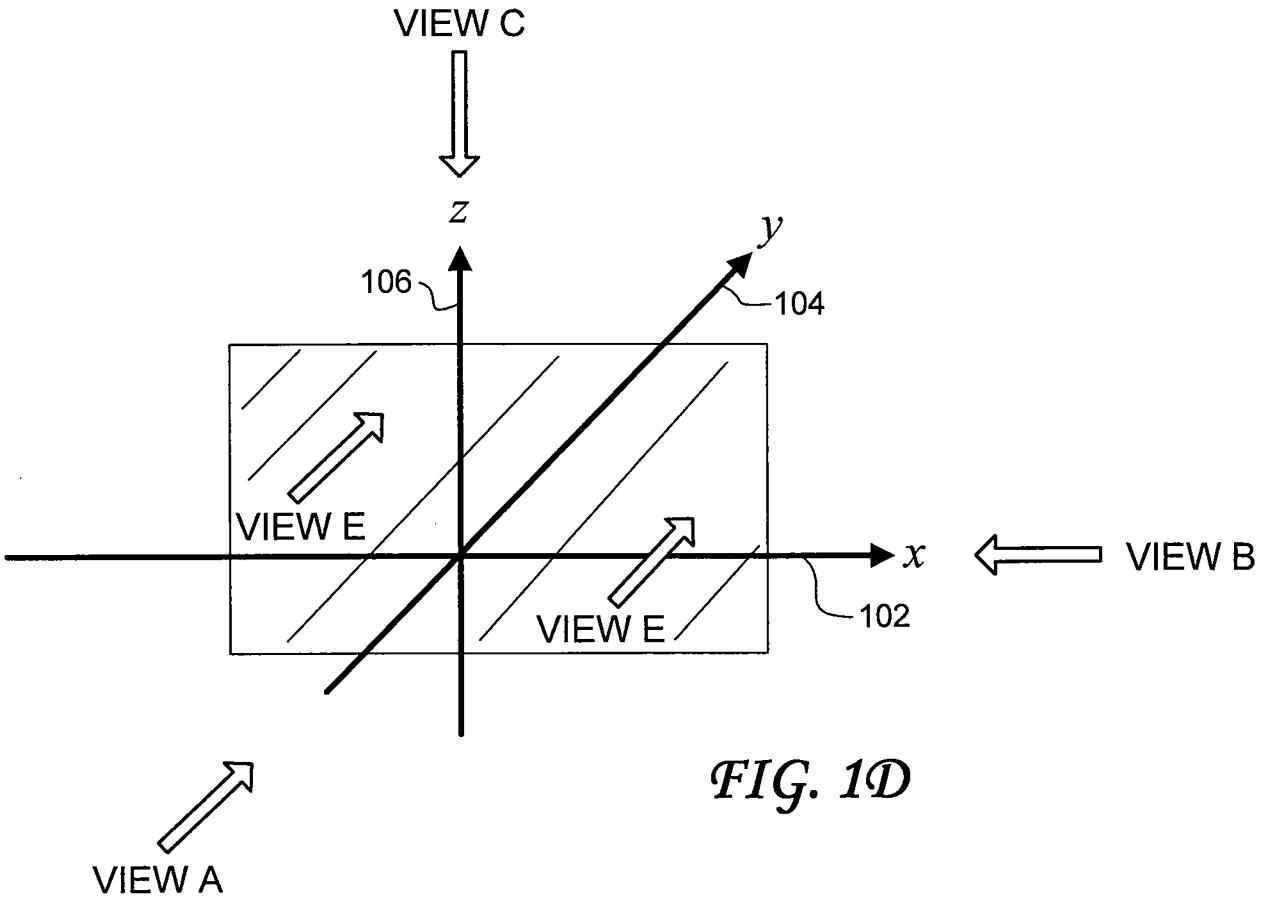
FIG. 1D shows orientations of reference views.

FIG. 1D defines the views for embodiments of antenna systems shown below. View A is sighted along the +y direction; View B is sighted along the −x direction; and View C is sighted along the −z direction. View E is a cross-sectional view in which the cross-sectional plane of the figure is parallel to the x-z plane; View E is sighted along the +y direction.

Figure 2A:
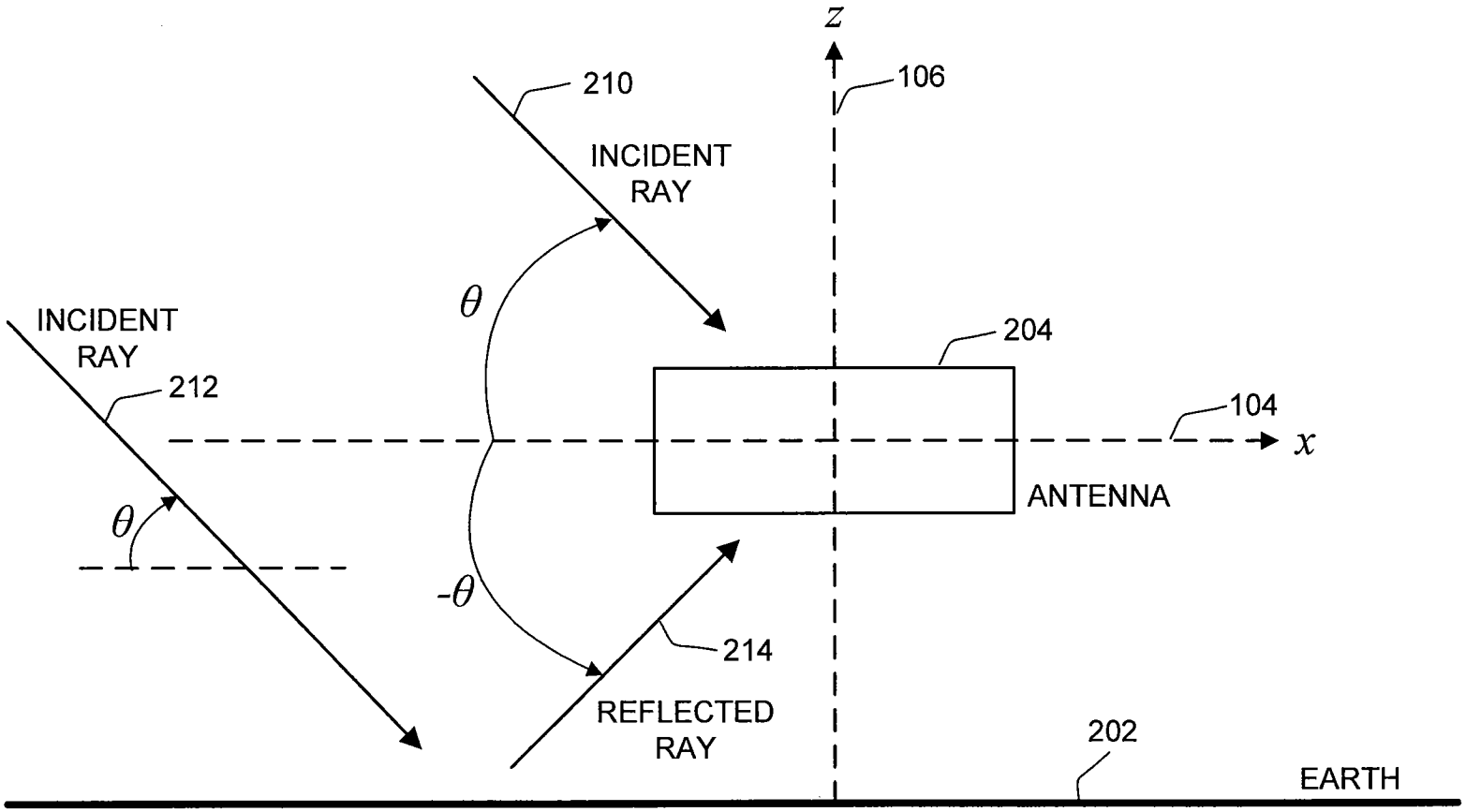
FIG. 2A shows a reference geometry for incident and reflected rays.

FIG. 2A shows a schematic of an antenna 204 positioned above the Earth 202. The antenna 204, for example, can be mounted on a surveyor's tripod (not shown) for geodetic applications. The plane of the figure is the E-plane (x-z plane). The +y direction points into the plane of the figure. In an open-air environment, the +z (up) direction (also referred to as the zenith) points towards the sky, and the −z (down) direction points towards the Earth. Herein, the term Earth includes both land and water environments. To avoid confusion with "electrical" ground (as used in reference to a ground plane), "geographical" ground (as used in reference to land) is not used herein.

In FIG. 2A, electromagnetic waves are represented as rays, incident upon the antenna 204 at an incident angle θ with respect to the x-axis. The horizon corresponds to θ=0 deg. Rays incident from the open sky, such as ray 210 and ray 212, have positive values of incident angle. Rays reflected from the Earth 202, such as ray 214, have negative values of incident angle. Herein, the region of space with positive values of incident angle is referred to as the direct signal region and is also referred to as the forward (or top) hemisphere. Herein, the region of space with negative values of incident angle is referred to as the multipath signal region and is also referred to as the backward (or bottom) hemisphere. Incident ray 210 impinges directly on antenna 204. Incident ray 212 impinges on Earth 202. Reflected ray 214 results from reflection of incident ray 212 off Earth 202.

To numerically characterize the capability of an antenna to mitigate the reflected signal, the following ratio is commonly used:

$$DU(\theta) = \frac{F(-\theta)}{F(\theta)}. \tag{E1}$$

The parameter DU (θ) (down/up ratio) is equal to the ratio of the antenna directional pattern level F(−θ) in the backward hemisphere to the antenna directional pattern level F(θ) in the forward hemisphere at the mirror angle, where F represents a voltage level. Expressed in dB, the ratio is:

$$DU(\theta)(\text{dB})=20 \log DU(\theta). \tag{E2}$$

Figure 2B:
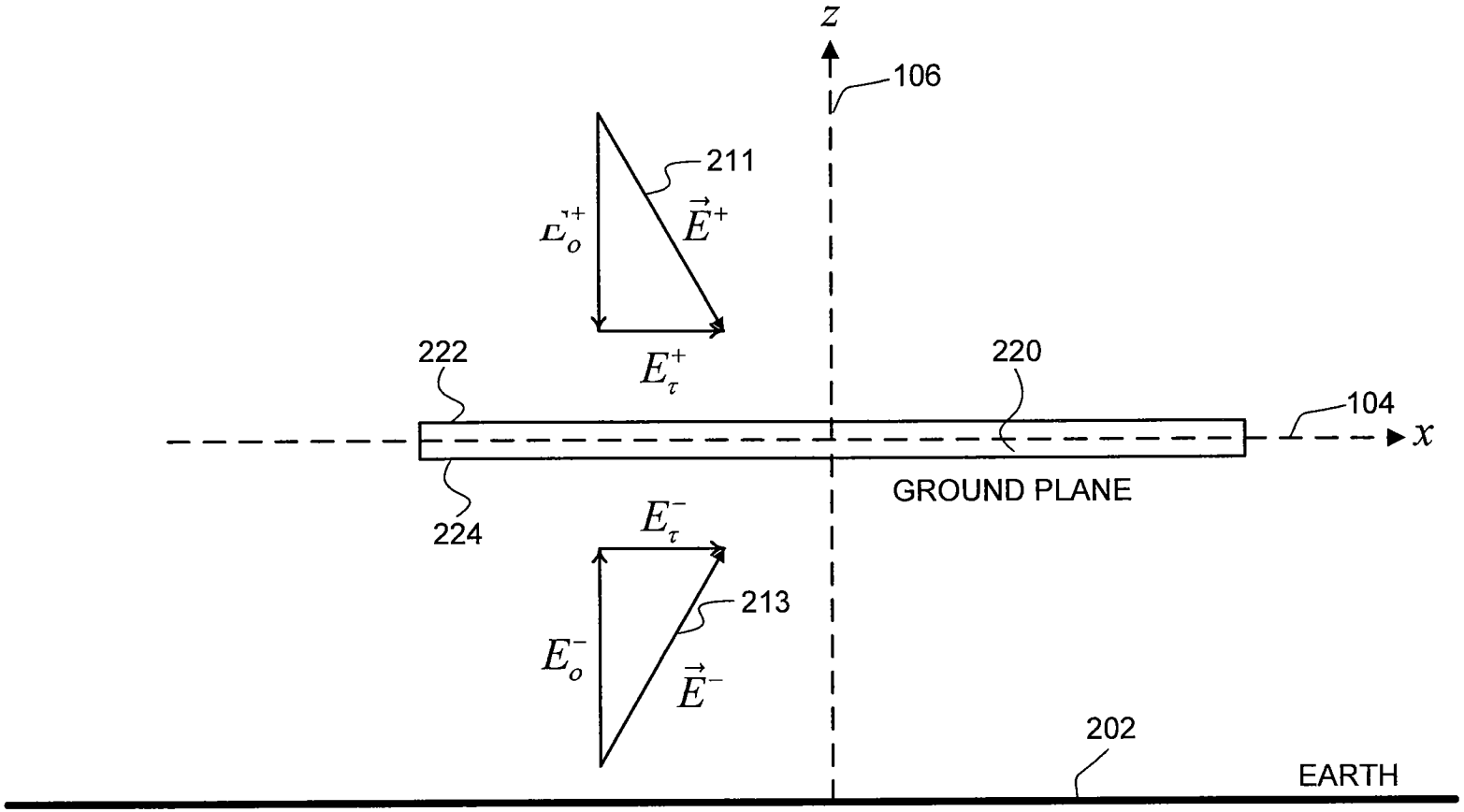
FIG. 2B shows a reference geometry for tangential and orthogonal vector components.

The electromagnetic characteristics of an antenna above the surface of a ground plane according to an embodiment of the invention can be modelled as follows. FIG. 2B shows a schematic of a ground plane 220 parallel to the x-y plane. Ground plane 220 has an upper ground plane surface 222 and a lower ground plane surface 224. Specific boundary conditions for the tangential components of the electric and magnetic fields on the ground plane surface are satisfied. In FIG. 2B, incident electric field vector $\vec{E}^+$211 has a tangential component $E_\tau^+$ parallel to upper ground plane surface 222 and an orthogonal component $E_o^+$ orthogonal to upper ground plane surface 222. Reflected electric field vector $\vec{E}^-$213 has a tangential component $E_\tau^-$ parallel to lower ground plane surface 224 and an orthogonal component $E_o^-$ orthogonal to lower ground plane surface 224. Components of the magnetic field vectors (not shown) are similarly defined: incident magnetic field vector $\vec{H}^+$ has a tangential component $H_\tau^+$ parallel to upper ground plane surface 222 and an orthogonal component $H_o^+$ orthogonal to upper ground plane surface 222; reflected magnetic field vector $\vec{H}^-$ has a tangential component $H_\tau^-$ parallel to lower ground plane surface 224 and an orthogonal component $H_o^-$ orthogonal to lower ground plane surface 224.

In one model, approximate or averaged boundary conditions can be used because the distances between structural and electrical elements on the ground plane surface (see below) are negligible compared to the wavelength of the received signal. In general, these boundary conditions are expressed by the relationships $$\begin{cases} E_\tau^+ = E_\tau^- = E_\tau \\ H_\tau^+ - H_\tau^- = j_\tau^e = \dfrac{E_\tau}{Z_S}; \end{cases} \tag{E3}$$

where $j_\tau^e$ is the surface density of the equivalent current, and $Z_S$ is the layer impedance (measured in ohms).

The boundary condition for the electric field specifies that the tangential component of the electric field, $E_\tau^+=E_\tau^-=E_\tau$, is continuous on the ground plane surface. The boundary condition for the magnetic field specifies that the tangential component of the magnetic field $H_\tau^+$; $H_\tau^-$ has a step on the ground plane surface. The value of this step is equal to $j_\tau^e$, the surface density of the equivalent electric current, with $$j_\tau^e = \frac{E_\tau}{Z_S}.$$

In the general case, the layer impedance $Z_S$ is a tensor whose elements are complex numbers specified by active and reactive components [or, equivalently, modulus (amplitude) and phase].

The distribution of the layer impedance on the surface of the ground plane controls the equivalent electric current. In an embodiment, an antenna system includes an antenna disposed on a semi-transparent ground plane. Characteristics of a semi-transparent ground plane are discussed in detail below. The antenna includes a radiator element and a ground element. The ground portion of an antenna is commonly referred to as the ground plane of the antenna. To avoid confusion with the ground plane described herein, the ground portion of an antenna is referred to as the ground element. The overall antenna pattern, and the down/up ratio, of the antenna system are determined by the sum of the radiator pattern and a pattern formed by the electric current of the ground plane. The desired DU(θ) parameter, therefore, depends on the distribution of layer impedance on the surface of the ground plane.

Figure 3A:
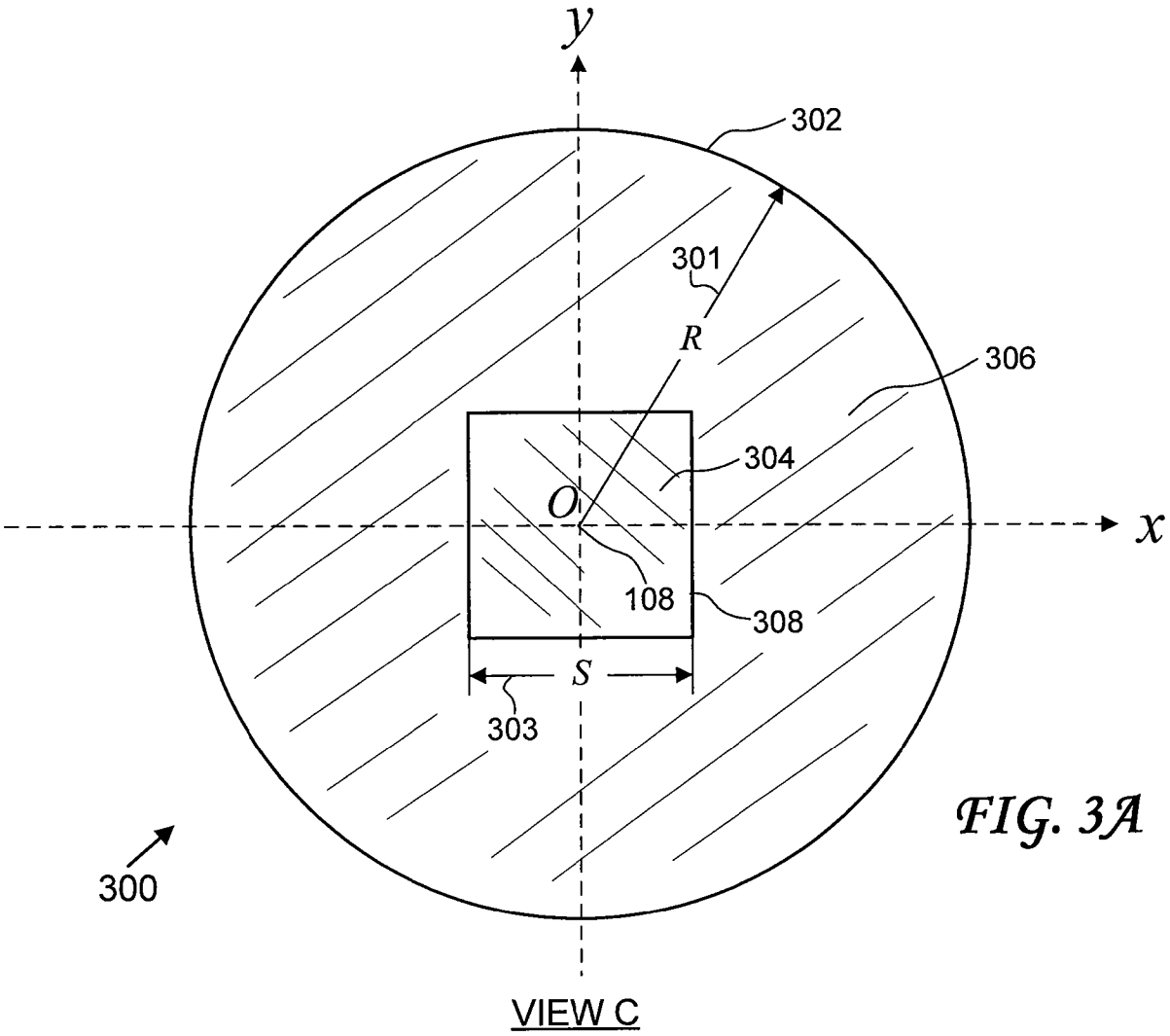
FIG. 3A-FIG. 3C show a reference geometry for a semi-transparent ground plane.

FIG. 3A shows View C of a semi-transparent ground plane according to an embodiment of the invention. The semi-transparent ground plane 300 has an outside perimeter 302 and an inside perimeter 308. The region within inside perimeter 308 is referred to as the central region 304. The region between inside perimeter 308 and outside perimeter 302 is referred to as the peripheral region 306. In FIG. 3A, outside perimeter 302 has a circular geometry with radius R 301, and inside perimeter 308 has a square geometry with side S 303.

Figure 3B:
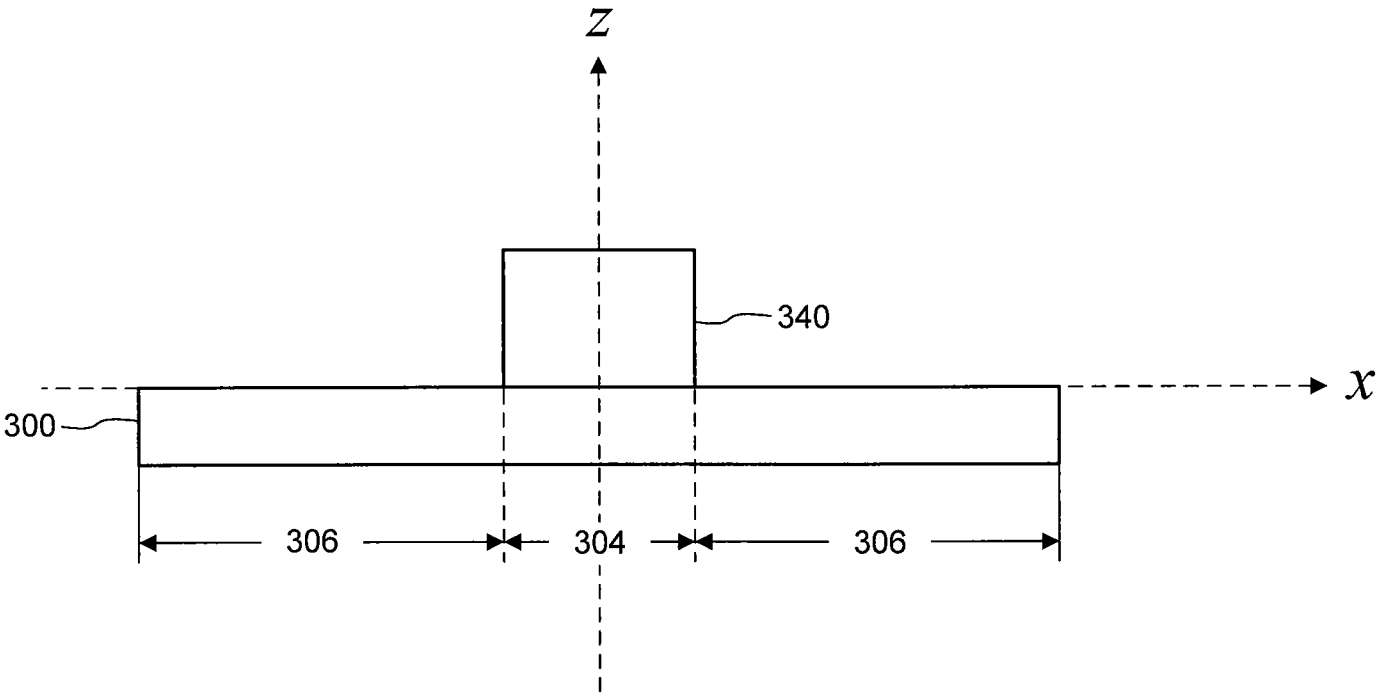

Refer to View A shown in FIG. 3B. Antenna 340 (which has a radiator element and a ground element) is disposed on central region 304. Examples of antenna 340 include patch antennas, helical antennas, and cavity antennas. As discussed below, the top surface of central region 304 is conductive. In general, the ground element of antenna 340 is in electrical contact with the conductive surface of central region 304. In one embodiment, semi-transparent ground plane 300 serves as the integral ground element of a patch antenna: a radiator patch is disposed above central region 304; the radiator patch and the central region 304 is separated by a dielectric such as air or a dielectric substrate. In another embodiment, semi-transparent ground plane 300 serves as a separate, supplementary ground plane for a patch antenna: antenna 340 is a complete stand-alone patch antenna including a radiator patch and a ground element separated by a dielectric; antenna 340 is then disposed on central region 304 of semi-transparent ground plane 300 to reduce multipath reception.

In general, the outside perimeter and the inside perimeter can have independent user-defined geometries. Other examples of geometries include ellipses, rectangles, and hexagons. User-defined geometries are specified, for example, by an antenna design engineer for specific applications. In an embodiment, the geometry of inside perimeter 308 is designed to conform to the geometry of the antenna 340. In an embodiment, inside perimeter 308 and outside perimeter 302 have a common geometric center.

Figure 3C:
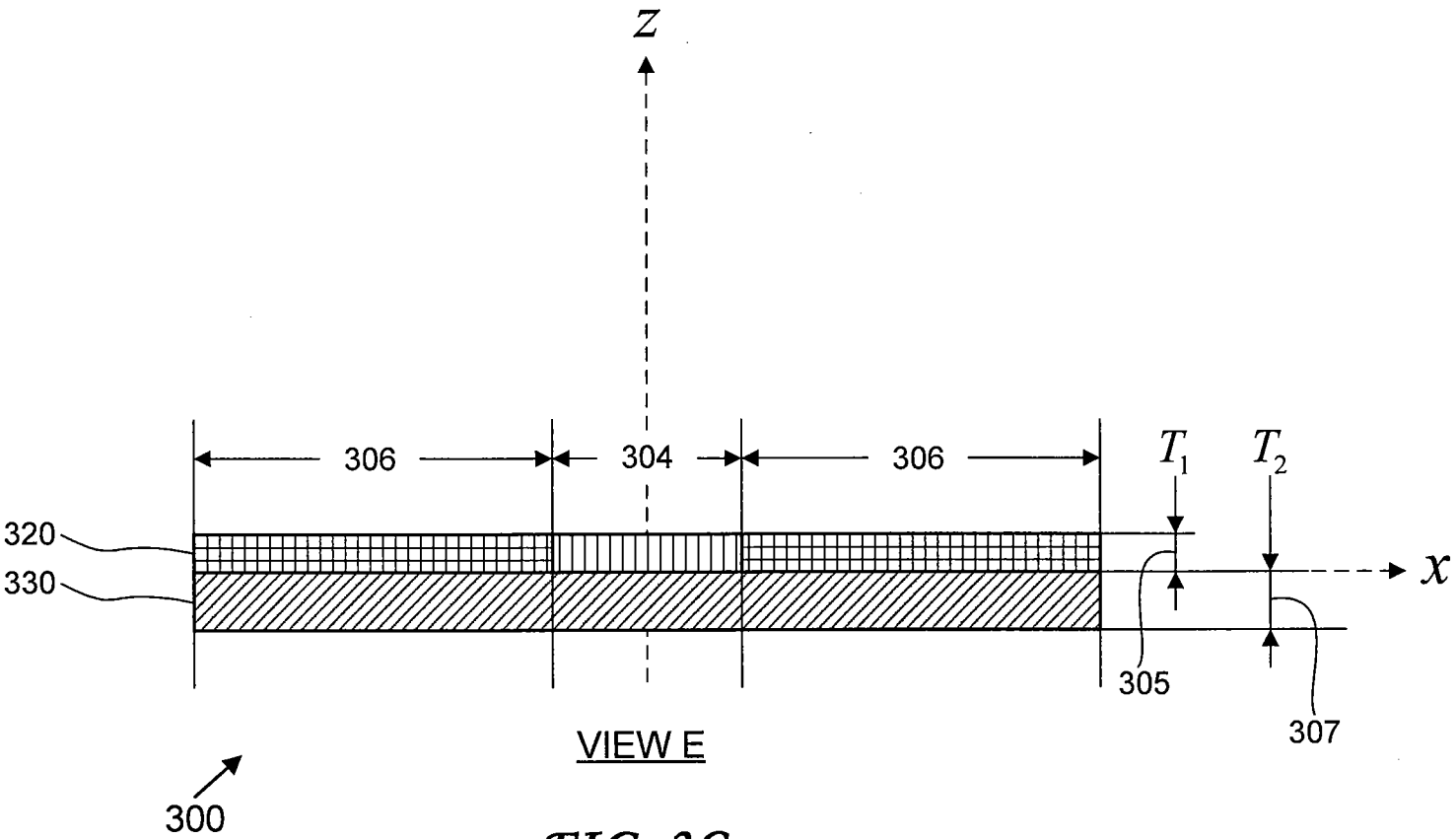

FIG. 3C shows View E of semi-transparent ground plane 300 according to an embodiment of the invention. Semi-transparent ground plane 300 includes a conductive layer 320 disposed on an insulating layer 330. The thickness of conductive layer 320 is $T_1$ 305; the thickness of insulating layer 330 is $T_2$ 307. In an embodiment, insulating layer 330 is a dielectric substrate and conductive layer 320 is a metal film deposited on the dielectric substrate. Semi-transparent ground plane 300, for example, can be fabricated from a printed circuit board. In central region 304, the conductive layer 320 is a single continuous conductive segment. In peripheral region 306, the conductive layer 320 is partitioned into multiple conductive segments. In peripheral region 306, the conductive layer 320 is patterned with structural and electrical elements. Specific examples of structural and electrical elements are discussed below.

In the central region 304, the layer impedance is approximately zero (depending on the residual loss). In the peripheral region 306, a user-specified distribution of layer impedance (both amplitude and phase) is generated. The phase is controlled over the range of −90 degrees to +90 degrees.

In an embodiment, in peripheral region 306, the desired distribution of layer impedance is generated by configuring a set of grooves in the conductive layer and configuring a set of lumped circuit elements above or within the grooves. Herein, a lumped circuit element includes a single resistor (R), a single capacitor (C), a single inductor (C), and any combination of resistors, capacitors, and inductors (RCL). The resistors, capacitors, and inductors can be electrically connected in any series, parallel, or series-parallel combination. Configurable lumped circuit elements permit the control of the distribution of both the modulus (amplitude) and phase of the layer impedance (or equivalently, of the active and reactive components of the layer impedance). Control of the reactive component permits the active power loss to be reduced. Note that the layer impedance also depends on properties (such as thickness and permittivity) of the insulating layer.

In some embodiments, lumped circuit elements are discrete devices (such as discrete resistors, inductors, and capacitors) connected by wires and solder joints. In some embodiments, surface mount devices (devices utilizing surface mount technology) are used. In some embodiments, lumped circuit elements are fabricated as integrated circuit devices from thin films (conductive or insulating) on a dielectric substrate. For example, a resistor can be fabricated from a thin film with active power loss, an inductor can be fabricated from a thin metal film with a meander geometry, and a capacitor can be fabricated from a metal film with a comb geometry. Combinations of discrete devices, surface-mount devices, and integrated circuit devices can be used.

Semi-transparent ground plane 300 is referred to as a semi-transparent ground plane because an incident electromagnetic wave is partially transmitted and partially reflected. In characterizing the performance of an antenna, the characteristics in the receiving mode correspond to the characteristics in the transmitting mode (according to the well-known reciprocity theorem). In the transmitting mode, with a typical fully conductive ground plane, the electromagnetic field in the down direction arises from diffraction of the incident electromagnetic field over the edges of the ground plane. The incident electromagnetic field is generated by an antenna disposed on the ground plane. With a semi-transparent ground plane, the electromagnetic field in the down direction arises from two effects: partial transmission of the incident electromagnetic field through the ground plane surface and diffraction of the incident electromagnetic field over the edges of the ground plane. In a fully conductive ground plane, the distribution of the amplitude (magnitude) and phase of the electromagnetic field cannot be controlled. In a semi-transparent ground plane, however, the distribution of the amplitude and phase of the electromagnetic field can both be controlled.

Figure 15:
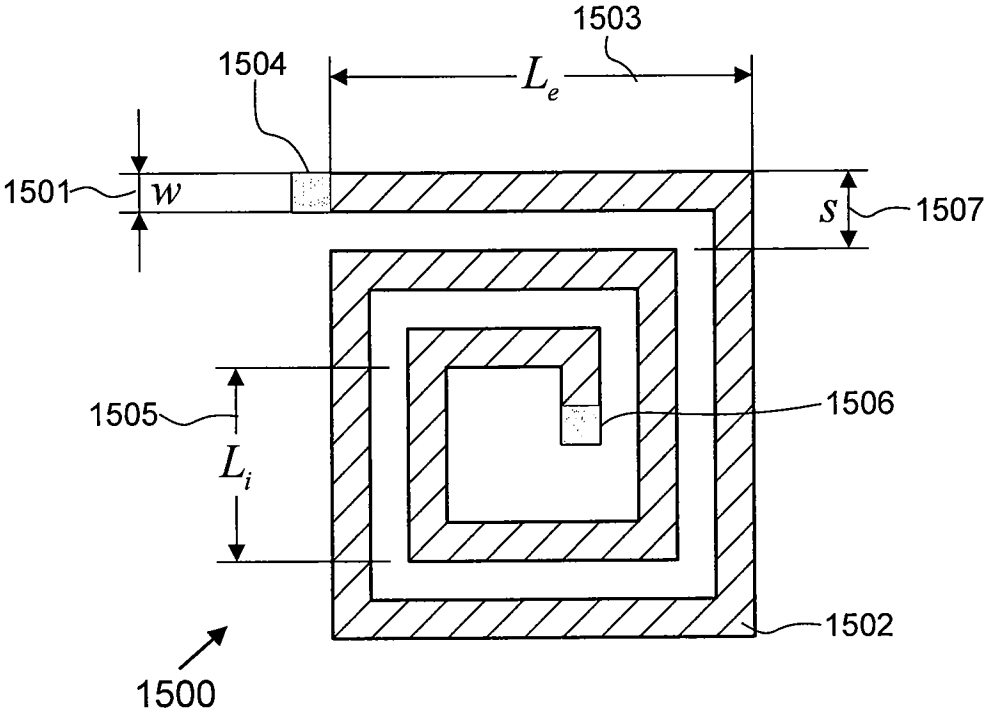
FIG. 15 shows a schematic of a printed circuit inductor.

FIG. 15 shows an example of a thin-film inductor 1500 fabricated on a dielectric substrate. Conductor 1502 is a metal strip with a meander geometry. The input/output ports are contact 1504 and contact 1506. Design parameters include width w 1501, outside length $L_e$ 1503, inside length $L_i$ 1505, and spacing s 1507.

Figure 16:
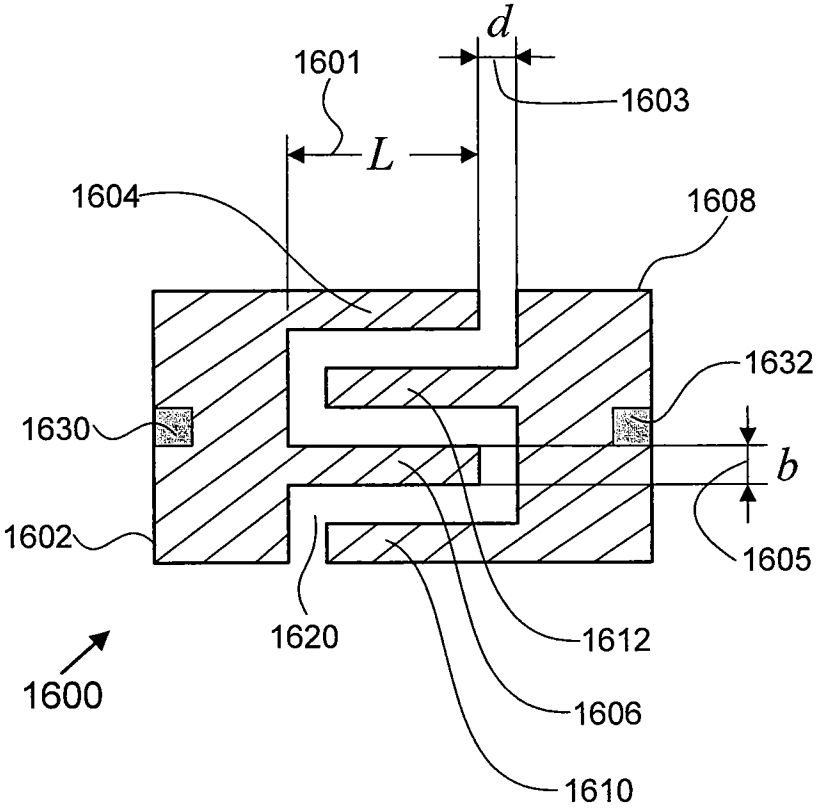
FIG. 16 shows a schematic of a printed circuit capacitor.

FIG. 16 shows an example of a thin-film capacitor 1600 fabricated on a dielectric substrate. Electrode 1602 and electrode 1608 have a comb (interdigitated) geometry. The input/output ports are contact 1630 and contact 1632. Electrode 1602 and electrode 1608 are separated by channel 1620. Finger 1604 and finger 1606 of electrode 1602 are interdigitated with finger 1612 and finger 1610 of electrode 1608. Design parameters include finger length L 1601, spacing d 1603, and width b 1605.

FIG. 4A-FIG. 4E show an embodiment of a semi-transparent ground plane 400, according to an embodiment of the invention, configured for linearly-polarized radiation. Refer to View C shown in FIG. 4B. Semi-transparent ground plane 400 has an outside perimeter 402 with a rectangular geometry and an inside perimeter 408 with a circular geometry. The lower side of outside perimeter 402 is denoted side 403; the upper side of outside perimeter 402 is denoted side 407. Side 403 and side 407 are parallel to the x-axis. The left side of outside perimeter 402 is denoted side 405; the right side of outside perimeter 402 is denoted side 409. Side 405 and side 409 are parallel to the y-axis. The lower left-hand corner of outside perimeter 402 is denoted reference point 401. The dimensions of outside perimeter 402 are $L_1$ 413 along the x-axis and $L_2$ 415 along the y-axis.

Inside perimeter 408 has a radius R 411. Outside perimeter 402 and inside perimeter 408 have a common geometrical center O 108. The region within the inside perimeter 408 is referred to as the central region 404, and the region between the inside perimeter 408 and the outside perimeter 402 is referred to as the peripheral region 406.

Figure 4A:
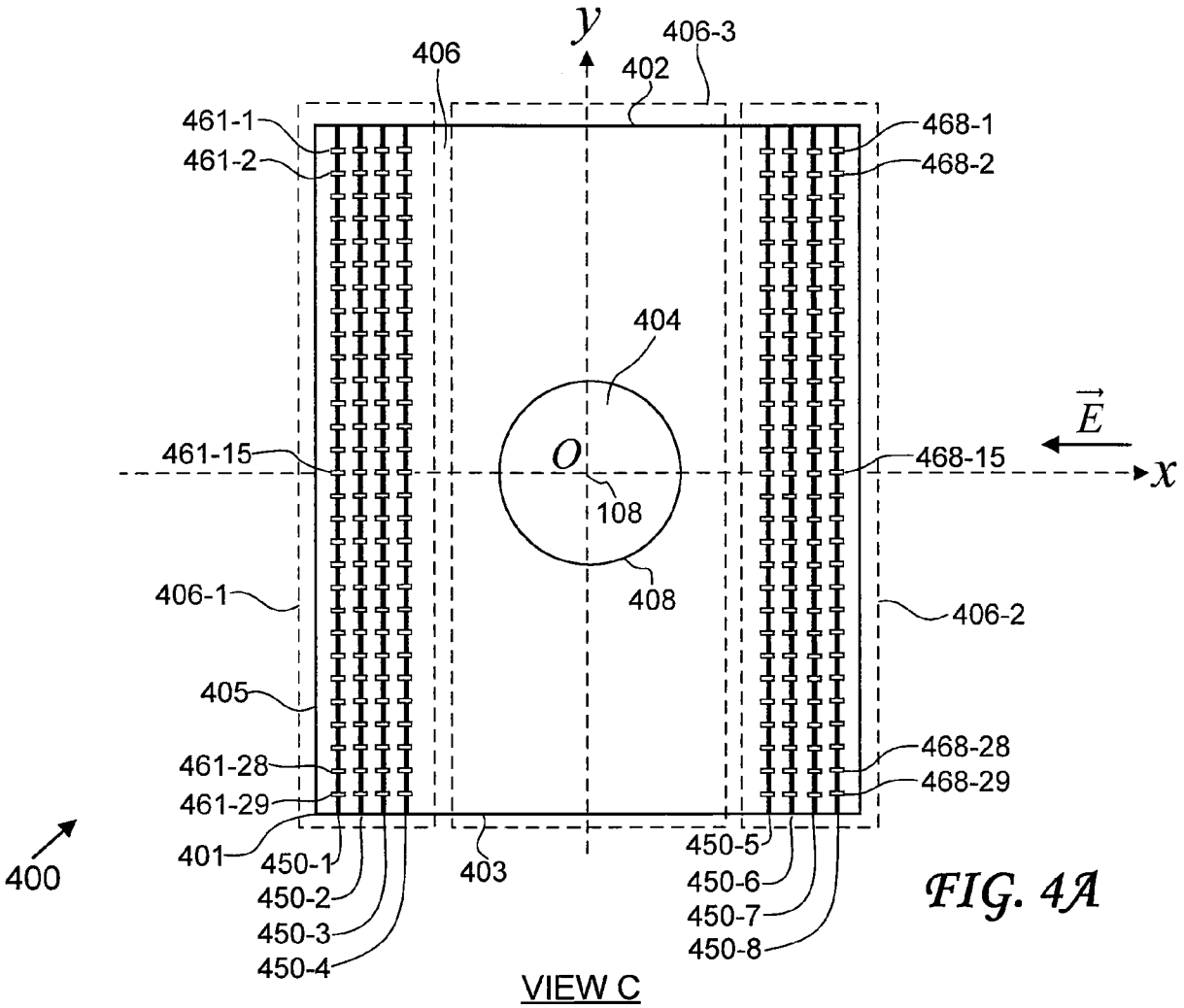
FIG. 4A-FIG. 4E show a first embodiment of a semi-transparent ground plane for linearly-polarized radiation.
Figure 4B:
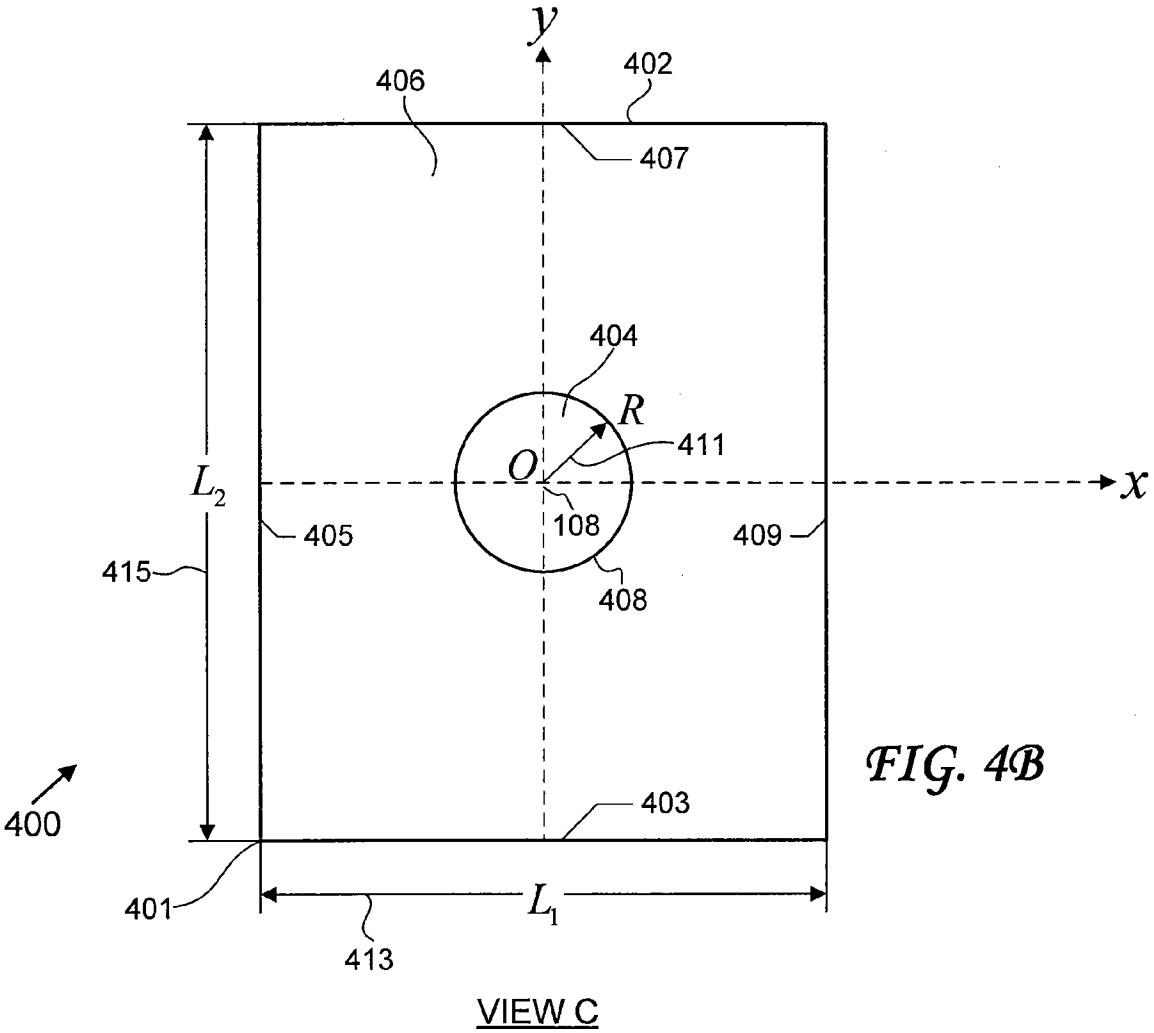
Figure 4C:
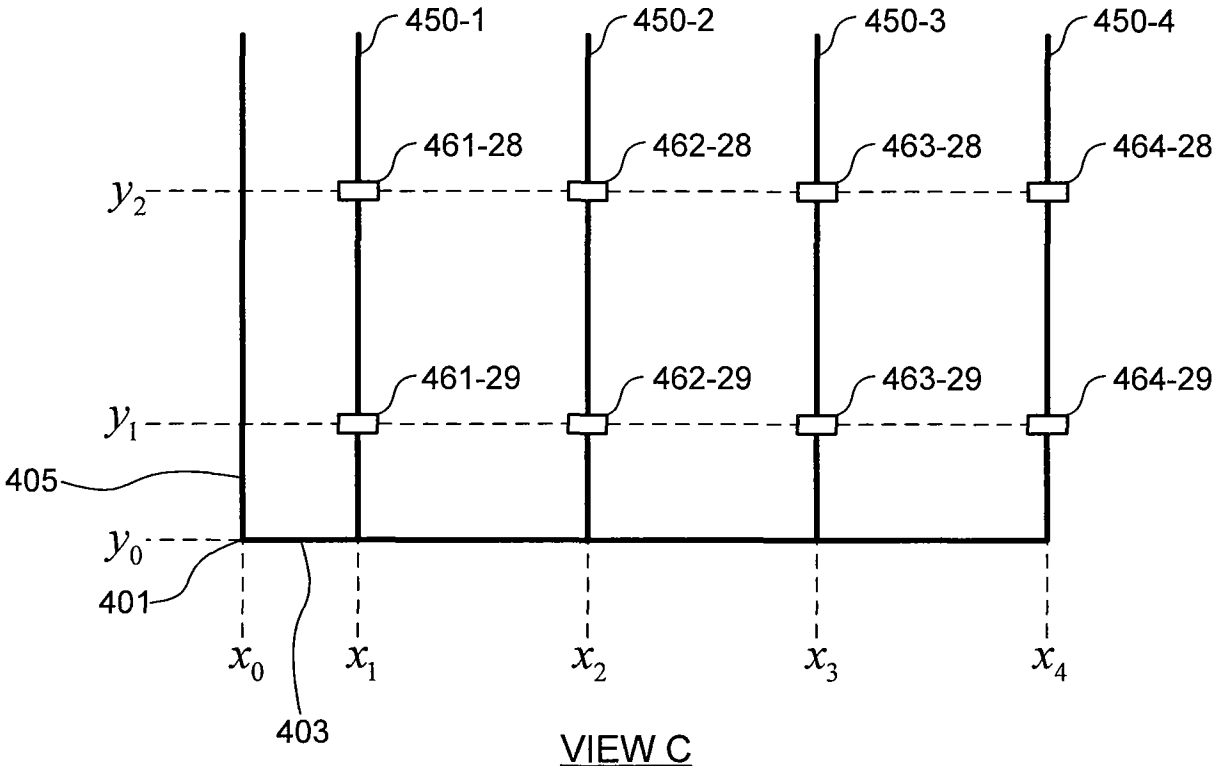
Figure 4D:
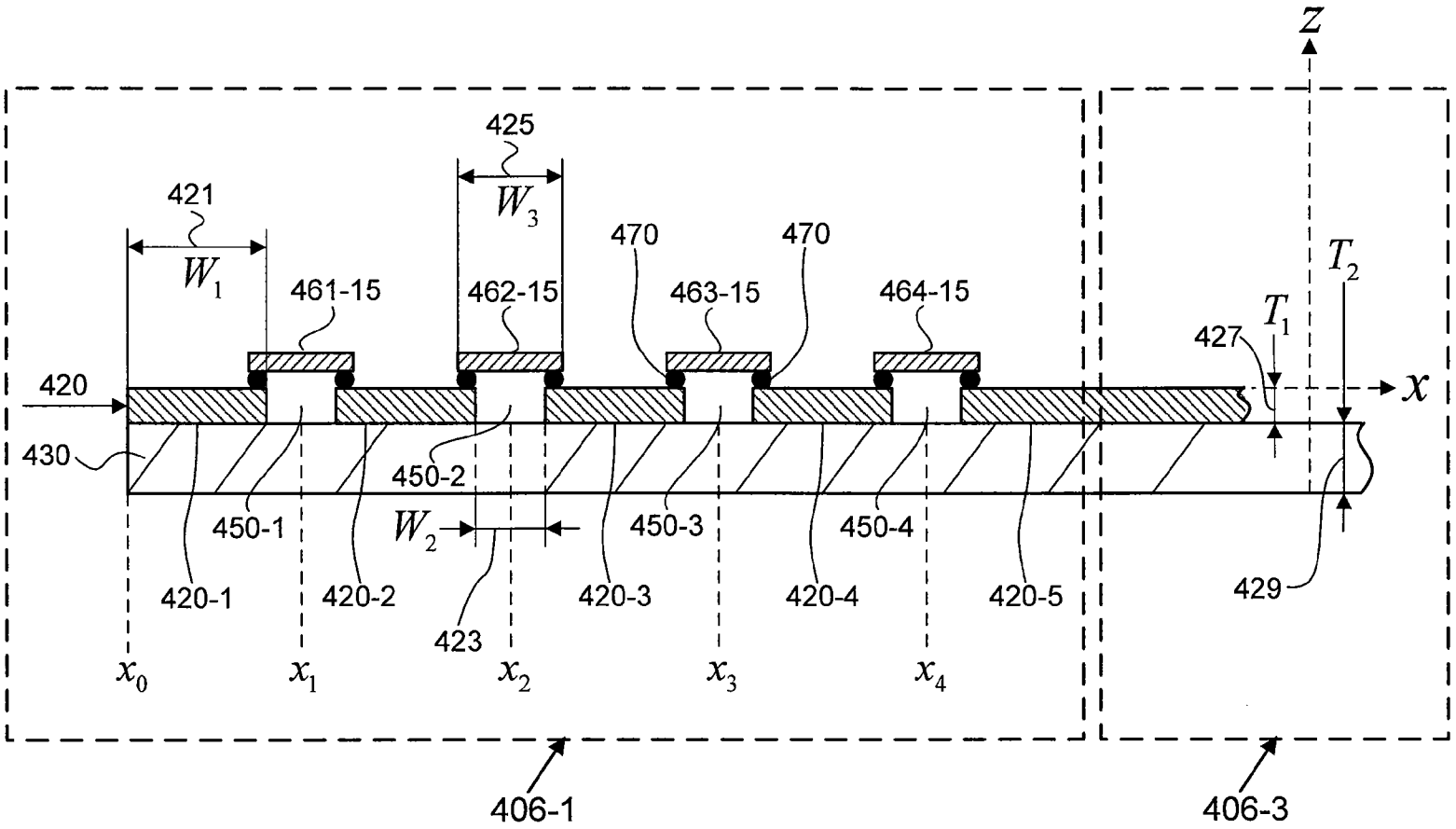
Figure 4E:
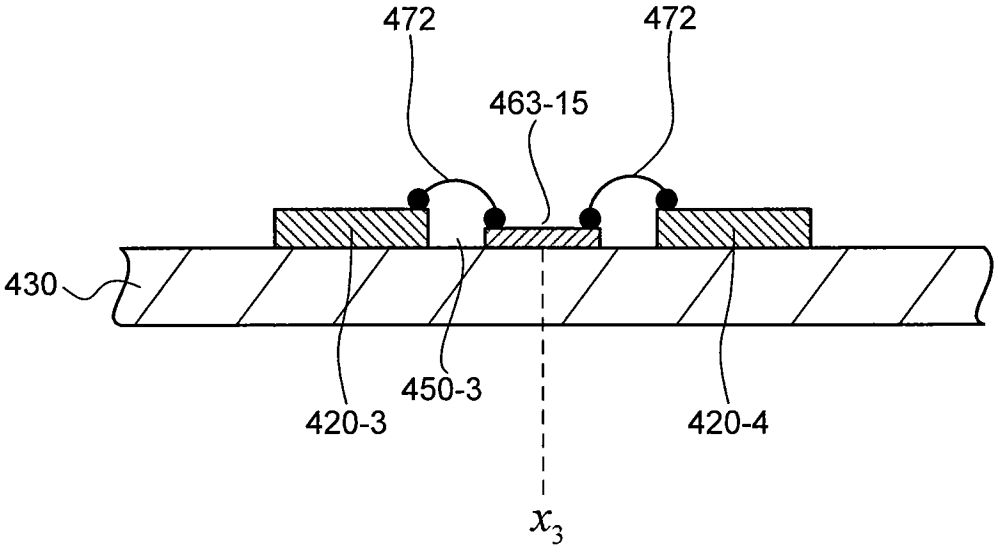

Refer to View E in FIG. 4D. Semi-transparent ground plane 400 includes a conductive layer 420 disposed on an insulating layer 430. In one example, conductive layer 420 is a thin metal film, and insulating layer 430 is a dielectric substrate. The thickness of conductive layer 420 is $T_1$ 427; and the thickness of insulating layer 430 is $T_2$ 429. Further details of FIG. 4D are discussed below.

Refer to View C in FIG. 4A. Peripheral region 406 is partitioned into three peripheral sub-regions, denoted peripheral sub-region 406-1, peripheral sub-region 406-2, and peripheral sub-region 406-3 (indicated by the dashed rectangles). In the peripheral sub-region 406-1 and in the peripheral sub-region 406-2 are a set of grooves parallel to the y-axis. Four grooves, labelled groove 450-1, groove 450-2, groove 450-3, and groove 450-4, are configured in the peripheral sub-region 406-1. Four grooves, labelled groove 450-5, groove 450-6, groove 450-7, and groove 450-8, are configured in the peripheral sub-region 406-2.

Refer back to FIG. 4D, which shows a cross-sectional view of the peripheral sub-region 406-1 and the peripheral sub-region 406-3. Groove 450-1, groove 450-2, groove 450-3, and groove 450-4 penetrate the total thickness of conductive layer 420; that is, the depth of a groove (measured along the z-axis) equals the thickness of the conductive layer. For example, the grooves can be fabricated by photolithographic patterning and etching of conductive layer 420. Groove 450-5, groove 450-6, groove 450-7, and groove 450-8 in the peripheral sub-region 406-2 (see FIG. 4A) are similar to those shown in FIG. 4D. In the peripheral sub-region 406-3, there are no grooves, and conductive layer 402 is continuous.

Refer to back to FIG. 4A. Across each groove is a set of 29 lumped circuit elements. Across the left-most groove, groove 450-1, the lumped circuit elements are labelled as lumped circuit element 461-1 to lumped circuit element 461-29. Across the right-most groove, groove 450-8, the lumped circuit elements are labelled as lumped circuit element 468-1 to lumped circuit element 468-29. The lumped circuit elements across the other grooves are similarly labelled. To simplify the figure, not all the labels are shown.

Refer to View C in FIG. 4C, which shows further details of the configuration of the grooves and lumped circuit elements. Reference point 401 has coordinates $(x_0, y_0)$. The grooves run parallel to the y-axis at $x=(x_1, x_2, x_3, x_4, \ldots, x_8)$. The lumped circuit elements are positioned along lines parallel to the x-axis at $y=(y_1, y_2, \ldots, y_{29})$. In general, the spacing between grooves ($\Delta x$) can vary. In some embodiments, the spacing between grooves is constant. In general, the spacing between lumped circuit elements ($\Delta y$) can vary, independently along the same groove and independently along different grooves. In some embodiments, the spacing between lumped circuit elements is constant.

The lumped circuit elements are aligned perpendicular to the grooves; that is, the longitudinal axis of a lumped circuit element is perpendicular to the longitudinal axis of the groove that is crosses. A lumped circuit element can be modelled as a two-port device. The longitudinal axis of the lumped circuit element is the axis along which the current flows from one port to the other. The current flow across the two ports can be approximated by a straight line.

Refer back to FIG. 4D, which shows details of the grooves and lumped circuit elements in the peripheral sub-region 406-1. The positions of the centerlines of groove 450-1, groove 450-2, groove 450-3, and groove 450-4 are $(x_1, x_2, x_3, x_4)$, respectively. For reference, the position of side 405 is denoted position $x_0$. The width of a groove is denoted $W_2$ 423. In the embodiment shown in FIG. 4D, each groove has the same width. In general, each groove can have a different width.

The grooves partition conductive layer 420 into conductive segments configured as conductive strips running parallel to the y-axis: conductive strip 420-1, conductive strip 420-2, conductive strip 420-3, conductive strip 420-4, and conductive strip 420-5. The width of a conductive strip is denoted $W_1$ 421. In the embodiment shown in FIG. 4D, conductive strip 420-1, conductive strip 420-2, conductive strip 420-3, and conductive strip 420-4 have the same width. In general, each conductive strip can have a different width. Note that, in this embodiment, conductive strip 420-5 extends across the peripheral sub-region 406-3.

The conductive strips on both sides of a groove are electromagnetically coupled by lumped circuit elements. Herein, electromagnetic coupling includes both coupling with a direct electrical path between the two ports of a lumped circuit element (for example, a resistor) and coupling without a direct electrical path between the two ports of a lumped circuit element (for example, a capacitor). In FIG. 4D, the lumped circuit elements are labelled lumped circuit element 461-15, lumped circuit element 462-15, lumped circuit element 463-15, and lumped circuit element 464-15. The length of a lumped circuit element is denoted $W_3$ 425.

As a representative assembly, consider groove 450-3 bounded by conductive strip 420-3 and conductive strip 420-4. Lumped circuit element 463-15 forms an electromagnetically-coupled bridge from conductive strip 420-3 to conductive strip 420-4 across groove 450-3. Lumped circuit element 463-15 is electrically connected to conductive strip 420-3 and electrically connected to conductive strip 420-4.

A representative electrical connection is shown as electrical connection 470. An example of electrical connection 470 is a solder joint.

In another embodiment (FIG. 4E), a lumped circuit element 463-15 is disposed within groove 450-3. Lumped circuit element 463-15 is electrically connected to conductive strip 420-3 and electrically connected to conductive strip 420-4. A representative electrical connection is shown as electrical connection 472. An example of electrical connection 472 is a wire bond.

Refer back to FIG. 4A. In general, the number of grooves is a user-defined parameter, and the number of lumped circuit elements across a groove is a user-defined parameter. The number of lumped circuit elements across a groove can be independently varied for each groove. In some embodiments, the number of lumped circuit elements across each groove is the same. In a minimal configuration, there is a single groove with a single lumped circuit element in the peripheral region 406.

A linearly-polarized radiator induces a current on the semi-transparent ground plane. The current flows perpendicular to the grooves through the lumped circuit elements. In reference to FIG. 4A, the current flows parallel to the X-axis. As described above, the lumped circuit elements are electromagnetically coupled with the conductive layers of the semi-transparent ground plane. The configuration of the grooves and the lumped circuit elements generates a specific distribution of the amplitude and phase of the current. This distribution controls the down/up ratio.

In addition to the direct linearly-polarized radiation, the radiator radiates parasitic radiation. The direction of the parasitic radiation is orthogonal to the direct radiation. The parasitic radiation is cross-polarized (ninety degrees difference between the polarization vectors) with respect to the direct radiation. Consequently, there is an orthogonal current component, and the current flow is not strictly perpendicular to the grooves (that is, the current flow is not strictly parallel to the x-axis). Different configurations of grooves and lumped circuit elements are used to compensate for the parasitic component of current and to generate the desired down/up ratio for different polarization planes.

Figure 5A:
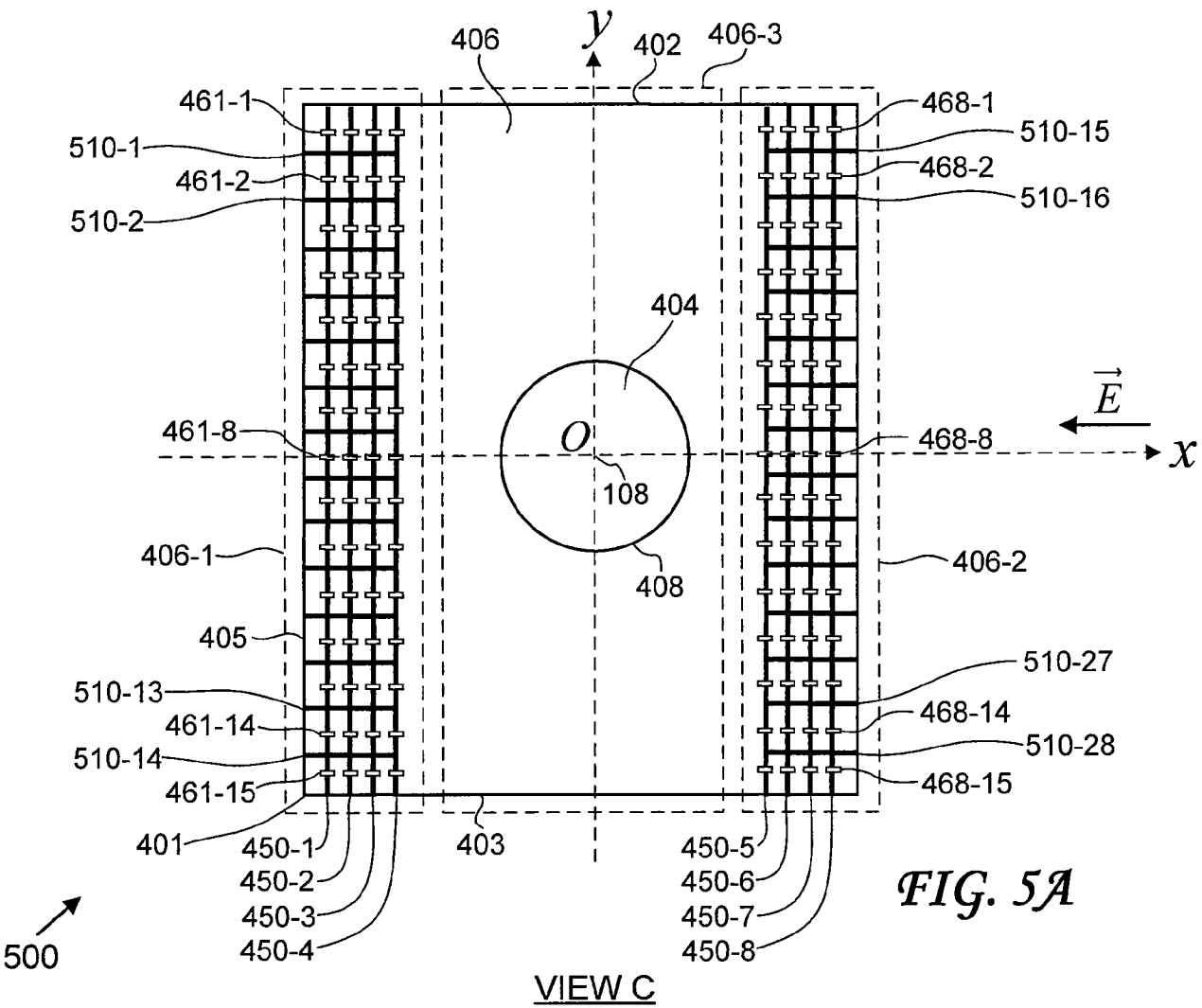
FIG. 5A and FIG. 5B show a second embodiment of a semi-transparent ground plane for linearly-polarized radiation.

FIG. 5A (View C) shows another embodiment of a semi-transparent ground plane configured for linearly-polarized radiation. Semi-transparent ground plane 500 is similar to ground plane 400 except there are cross grooves (parallel to the x-axis) perpendicular to the principal grooves (parallel to the y-axis) in the ground plane 400. In the peripheral sub-region 406-1, the set of cross grooves is labelled cross groove 510-1 through cross groove 510-14. In the peripheral sub-region 406-2, the set of cross grooves is labelled cross groove 510-15 through cross groove 510-28. Note that there are no lumped circuit elements positioned across the cross grooves. The cross grooves partition a conductive strip into a set of conductive segments configured as a series of rectangles.

Figure 5B:
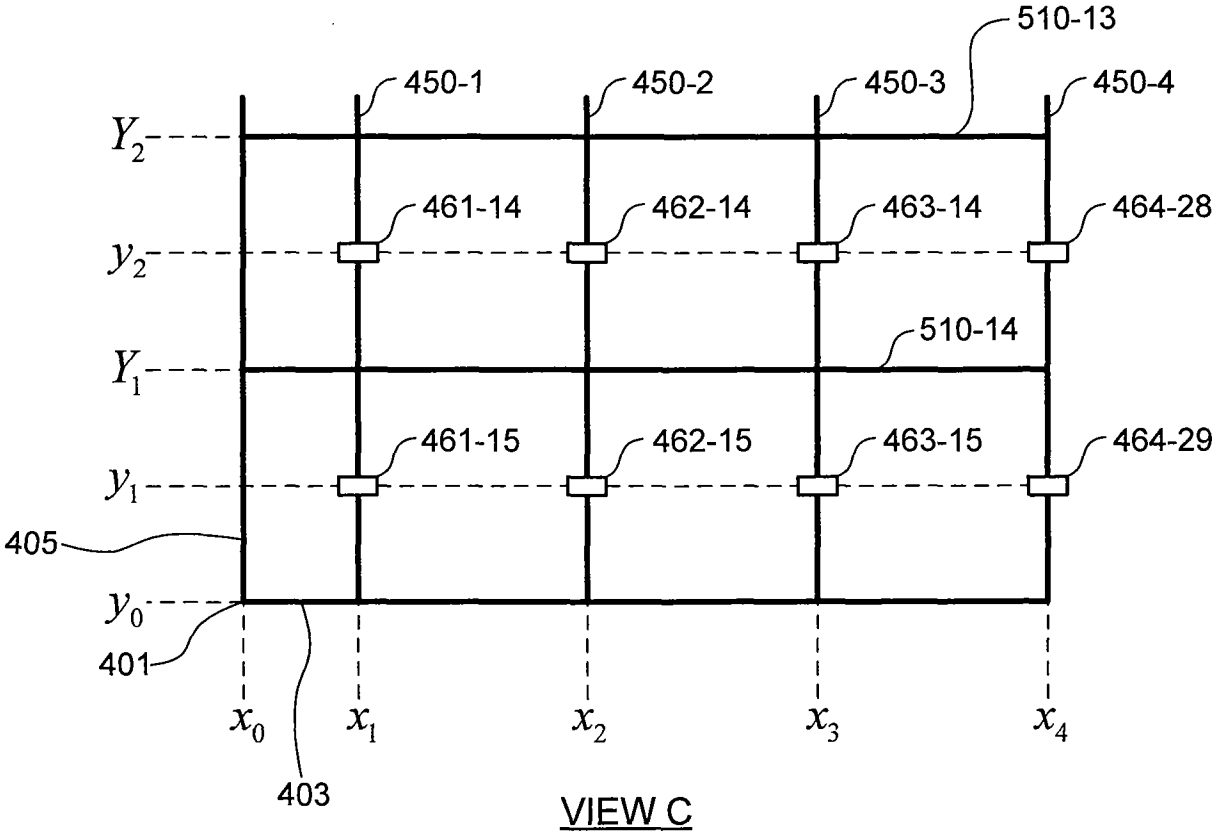

FIG. 5B (View C) shows details of the spacings of the set of cross grooves. The center lines of the cross grooves are positioned at $y=(Y_1, Y_2, Y_3, Y_4, \ldots)$. In general, the spacing between cross grooves ($\Delta Y$) can vary. In some embodiments, the spacing is constant. The number of cross grooves is a user-defined parameter. In an embodiment, there is a single cross groove in the peripheral sub-region 406-1 and a single cross groove in the peripheral sub-region 406-2.

Figure 6A:
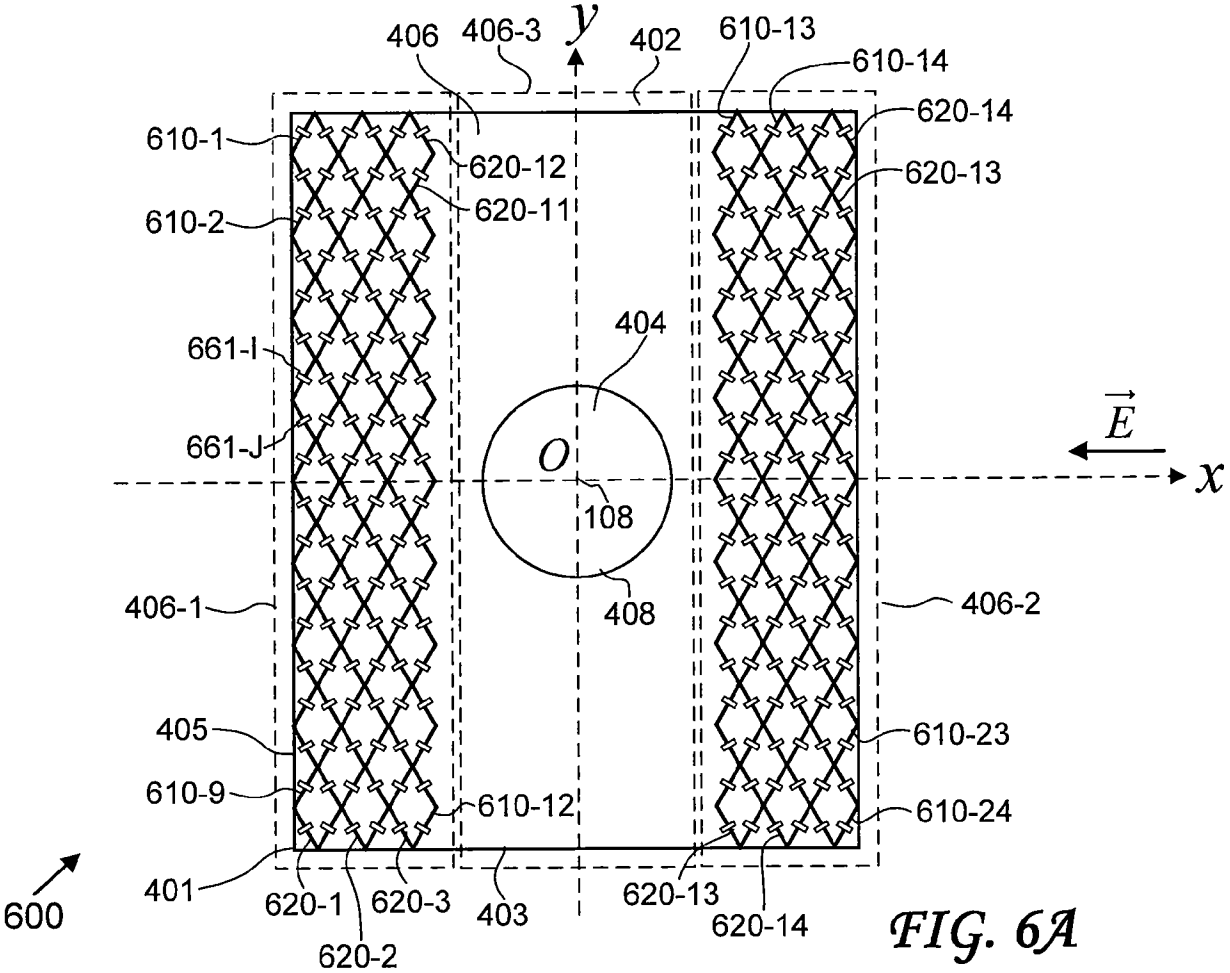
FIG. 6A and FIG. 6B show a third embodiment of a semi-transparent ground plane for linearly-polarized radiation.

FIG. 6A (View C) shows another embodiment of a semi-transparent ground plane (referenced as ground plane 600) configured for linearly-polarized radiation. In the peripheral sub-region 406-1, there is a first set of twelve parallel grooves 610-1 through 610-12 and a second set of twelve parallel grooves 620-1 through 620-12. In the peripheral sub-region 406-2, there is a first set of twelve parallel grooves 610-13 through 610-24 and a second set of twelve parallel grooves 620-13 through 620-14. A set of lumped circuit elements are positioned across the grooves. Representative lumped circuit elements are labelled lumped circuit element 661-I and lumped circuit element 661-J. The grooves form an array of rhombuses or portions of rhombuses. The grooves partition the conductive layer into an array of conductive segments configured as rhombuses or portions of rhombuses.

Figure 6B:
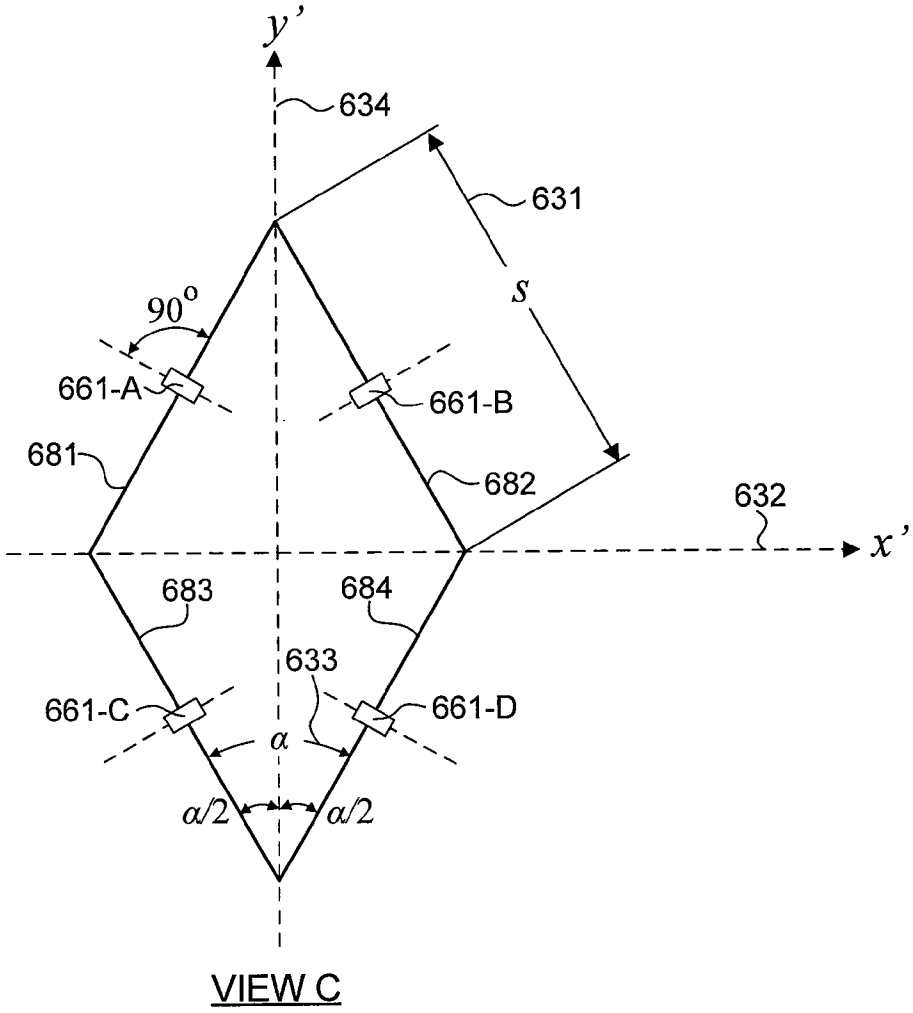

FIG. 6B shows the details of a single rhombus. Shown are a set of local reference axes, x'-axis 632 and y'-axis 634, parallel to the x-axis and y-axis, respectively. The four sides of the rhombus (labelled side 681, side 682, side 683, and side 684) each have a length s 631. The vertex angle is $\alpha$ 633. Lumped circuit element 661-A is connected across side 681; lumped circuit element 661-B is connected across side 682; lumped circuit element 661-C is connected across side 683; and lumped circuit element 661-D is connected across side 684. In this embodiment, the angle between a lumped circuit element and a groove is ninety degrees.

Figure 7A:
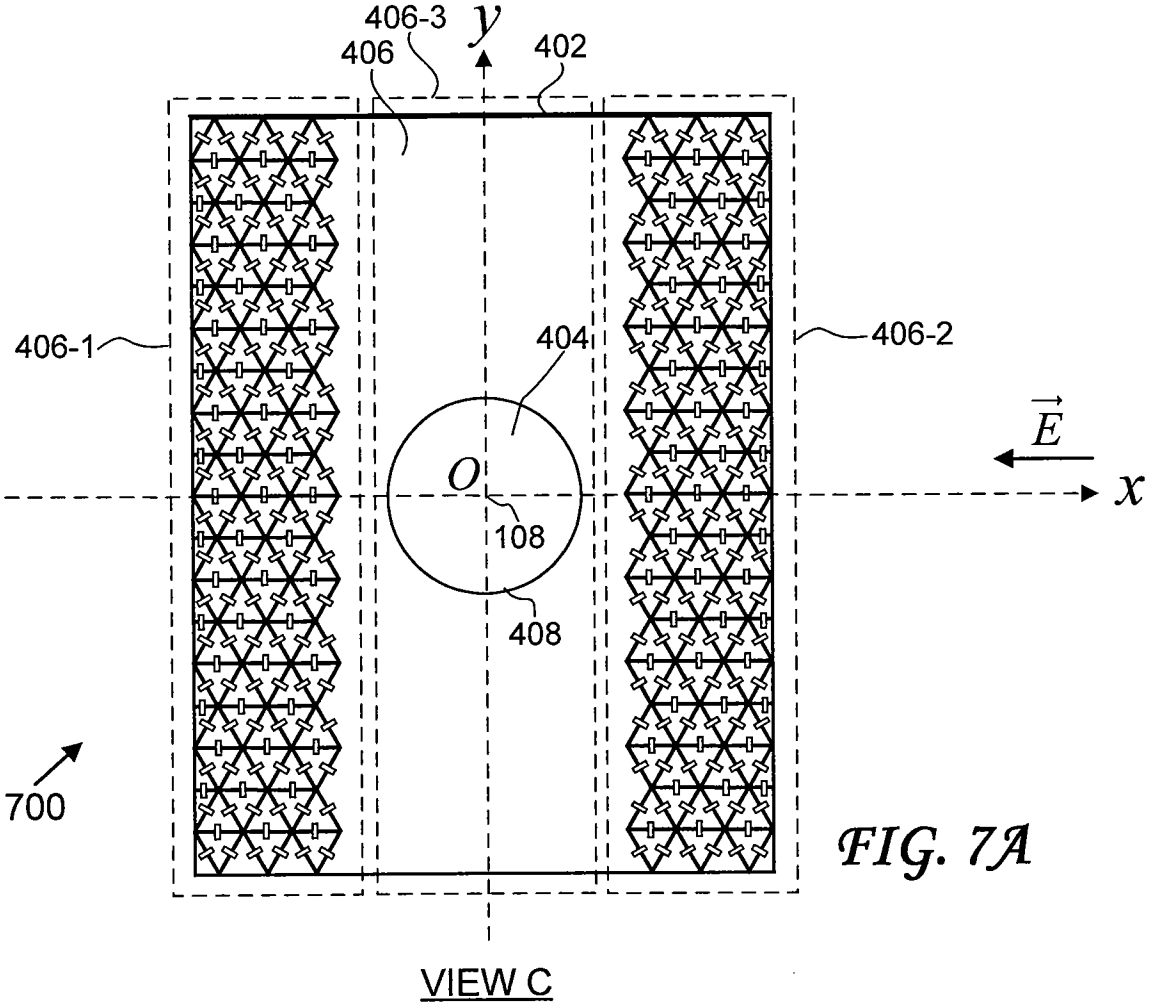
FIG. 7A and FIG. 7B show a fourth embodiment of a semi-transparent ground plane for linearly-polarized radiation.

FIG. 7A (View C) shows another embodiment of a semi-transparent ground plane (referenced as semi-transparent ground plane 700) configured for linearly-polarized radiation. In the peripheral sub-region 406-1 and the peripheral sub-region 406-2, there are sets of grooves and sets of lumped circuit elements across the grooves. The grooves form an array of equilateral triangles or portions of equilateral triangles. The grooves partition the conductive layer into an array of conductive segments configured as equilateral triangles or portions of equilateral triangles.

Figure 7B:
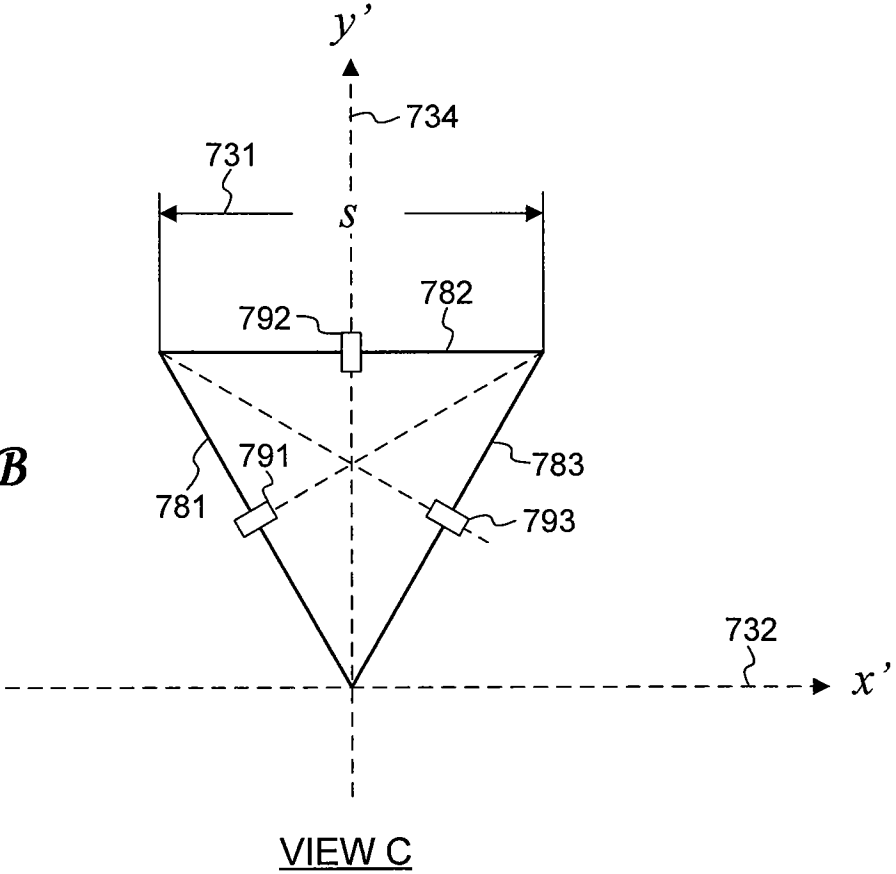

FIG. 7B shows the details of a single triangle. Shown are a set of local reference axes, x'-axis 732 and y'-axis 734, parallel to the x-axis and y-axis, respectively. The three sides of the triangle (labelled side 781, side 782, and side 783) each have a length s 731. Lumped circuit element 791 is connected across side 781; lumped circuit element 792 is connected across side 782; and lumped circuit element 793 is connected across side 783. In this embodiment, the angle between a lumped circuit element and a groove is ninety degrees.

Figure 8A:
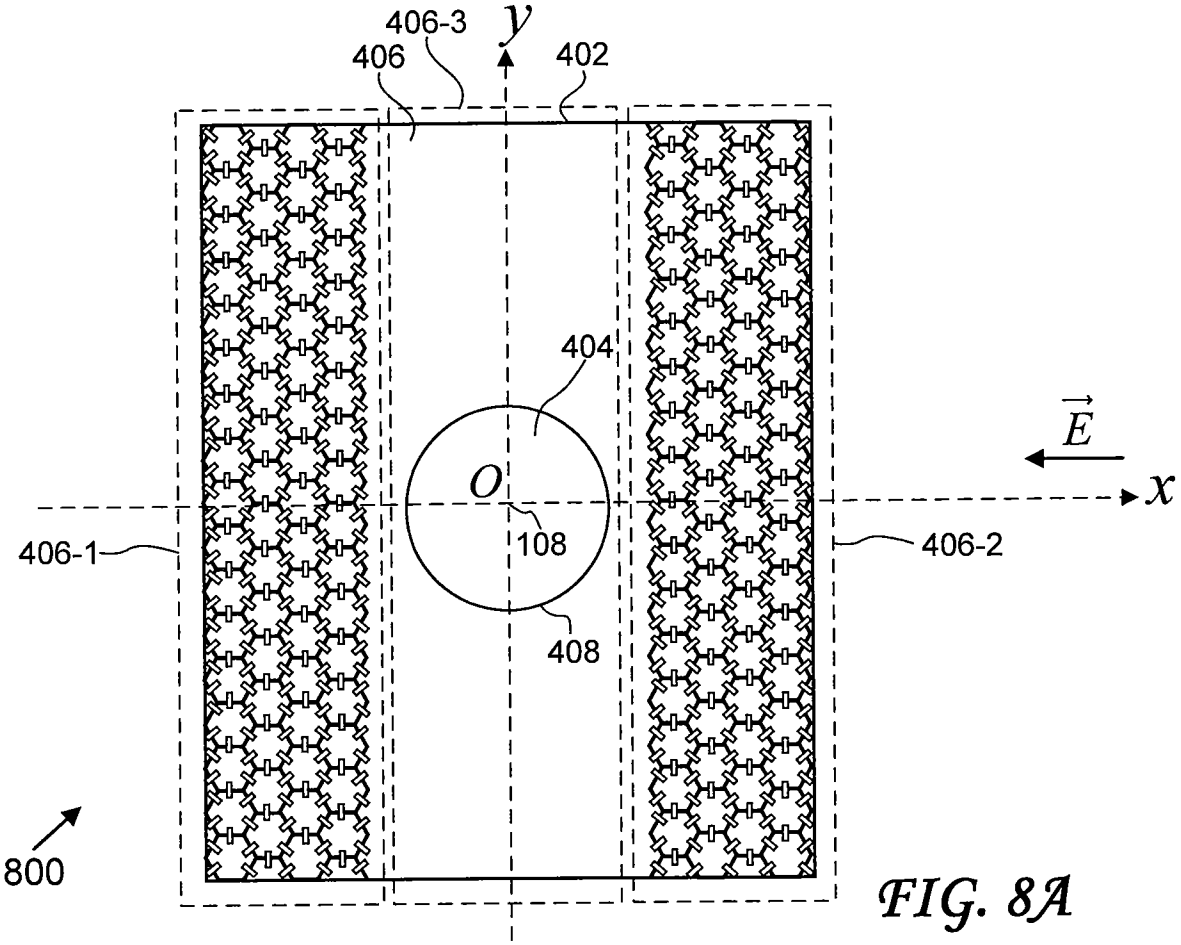
FIG. 8A and FIG. 8B show a fifth embodiment of a semi-transparent ground plane for linearly-polarized radiation.

FIG. 8A (View C) shows another embodiment of a semi-transparent ground plane (referenced as semi-transparent ground plane 800) configured for linearly-polarized radiation. In the peripheral sub-region 406-1 and the peripheral sub-region 406-2, there are sets of grooves and sets of lumped circuit elements across the grooves. The grooves form an array of regular hexagons or portions of regular hexagons. The grooves partition the conductive layer into an array of conductive segments configured as regular hexagons or portions of regular hexagons.

Figure 8B:
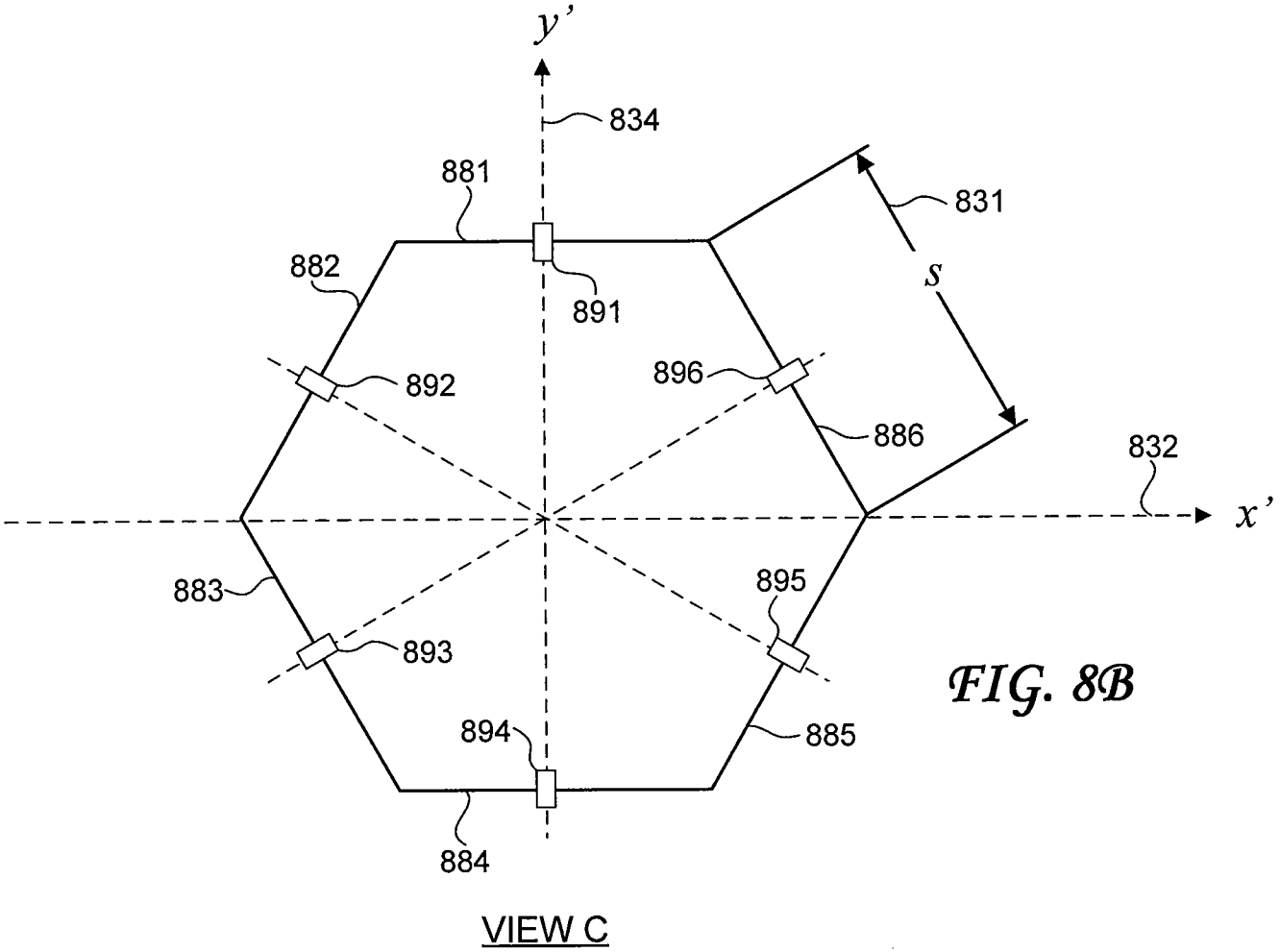

FIG. 8B shows the details of a single hexagon. Shown are a set of local reference axes, x'-axis 832 and y'-axis 834, parallel to the x-axis and y-axis, respectively. The six sides of the hexagon (labelled side 881-side 886) each have a length s 831. Lumped circuit element 891-lumped circuit element 896 are connected across side 881-side 886, respectively. In this embodiment, the angle between a lumped circuit element and a groove is ninety degrees.

In FIG. 4A, FIG. 5A, FIG. 6A, FIG. 7A, and FIG. 8A, the semi-transparent ground planes are configured for linearly-polarized radiation. The sets of grooves and lumped circuit elements are configured in a rectangular region along the left-hand side and in a rectangular region along the right-hand side of the semi-transparent ground planes. In embodiments of semi-transparent ground planes configured for circularly-polarized radiation, similar configurations of grooves and lumped circuit elements are configured along all four sides of the ground planes.

For circularly-polarized radiation, the radiator induces two current components: a radial component directed from the center of the ground plane to the outer perimeter and an azimuthal component directed along a circle about the center. The down/up ratio is determined in two mutually orthogonal planes (E and H planes). For a circularly-polarized antenna that has two orthogonal current components, different configurations of grooves and lumped circuit elements are used to achieve the desired down/up ratio in two orthogonal planes relative to the center of the ground plane.

Figure 9A:
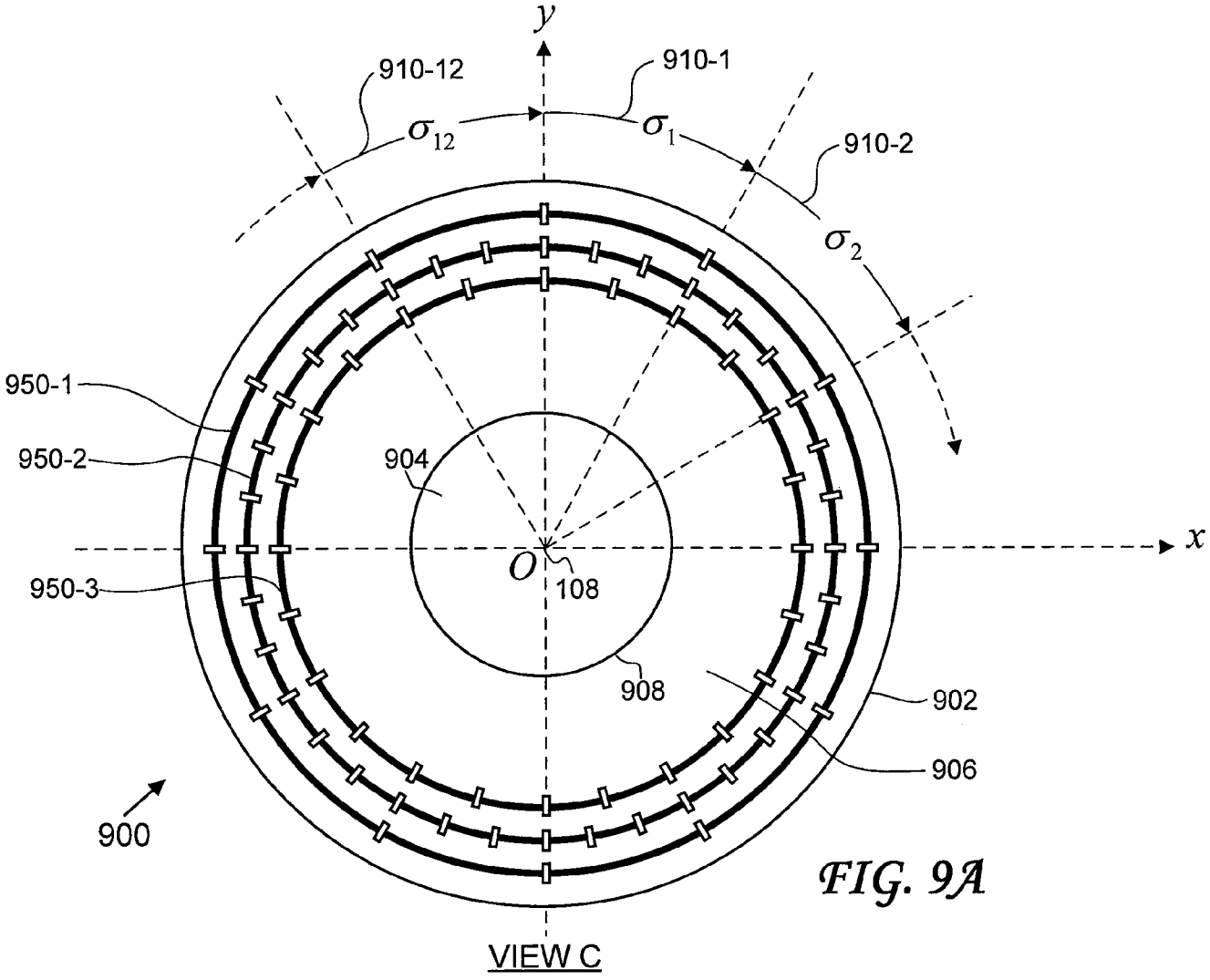
FIG. 9A and FIG. 9B show a first embodiment of a semi-transparent ground plane for circularly-polarized radiation.

FIG. 9A (View C) shows an embodiment of a semi-transparent ground plane configured for circular polarization. Semi-transparent ground plane 900 has an outer perimeter 902 with a circular geometry and an inner perimeter 908 with a circular geometry. The region within inner perimeter 908 is referred to as the central region 904. The region between inner perimeter 908 and outer perimeter 902 is referred to as the peripheral region 906.

Cross-sectional views (not shown) orthogonal to the x-y plane are similar to those shown in FIG. 3C and FIG. 4D. Within the central region 904, the conductive layer is continuous. Within the peripheral region 906 is a set of grooves configured as a set of concentric circles, labelled groove 950-1, groove 950-2, and groove 950-3. The grooves partition the conductive layer into conductive segments configured as a set of annular rings. Across each groove is a set of lumped circuit elements. The geometry of the grooves and lumped circuit elements form a repeating array of twelve sectors, labelled sector $\sigma_1$ 910-1 through sector $\sigma_{12}$ 910-12.

Figure 9B:
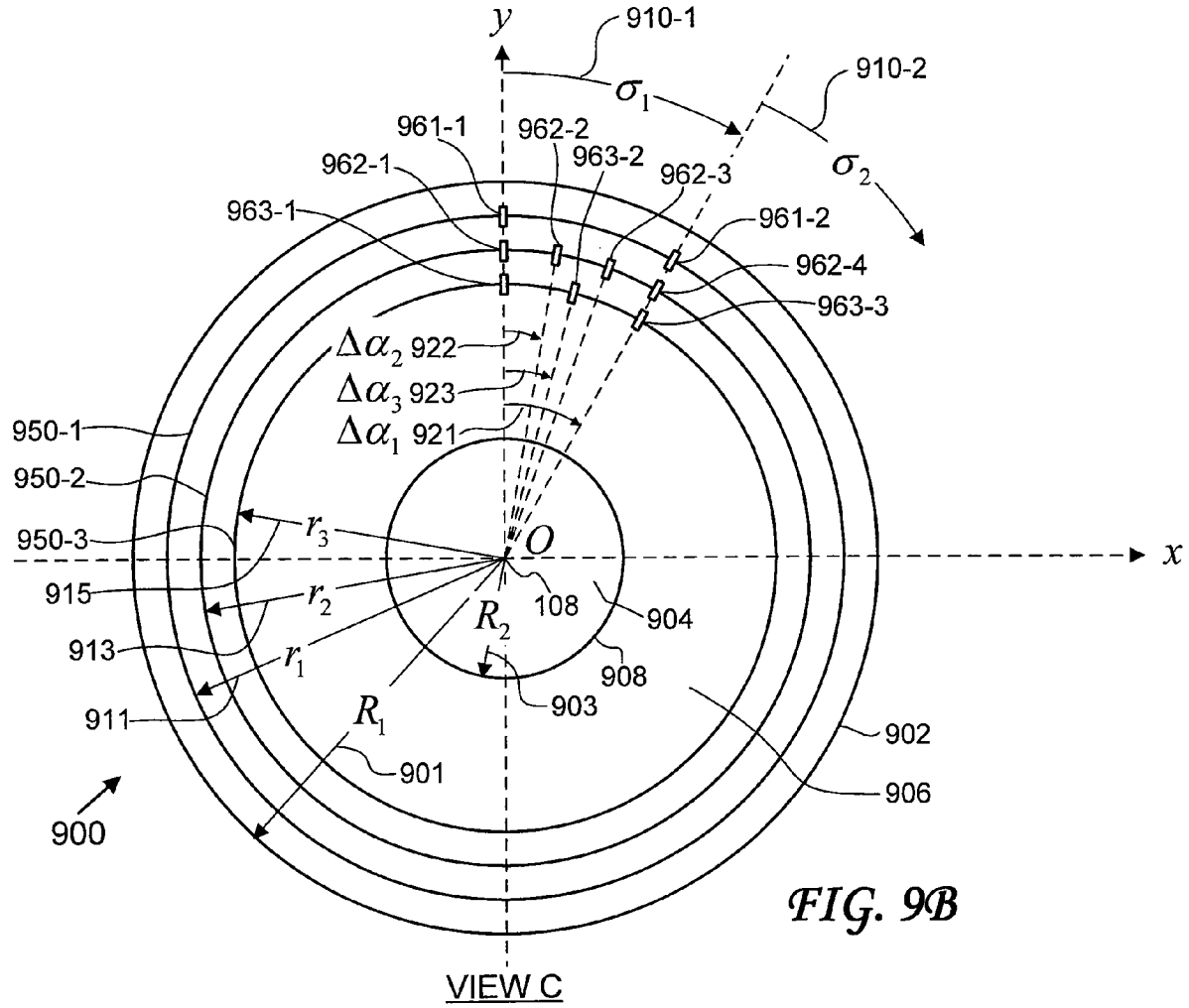

FIG. 9B shows additional dimensional details. Outer perimeter 902 has a radius $R_1$ 901, and inner perimeter 908 has a radius $R_2$ 903. The radii of groove 950-1, groove 950-2, and groove 950-3 are $r_1$ 911, $r_2$ 913, and $r_3$ 915, respectively.

Details of a representative sector, sector $\sigma_1$ 910-1, are shown in FIG. 9B. Azimuthal angles $\alpha$ are measured clockwise from the y-axis. Sector $\sigma_1$ 910-1 starts at $\alpha=0$ and ends at $\alpha=\Delta\alpha_1$ 921. Along groove 950-1, groove 950-2, and groove-3, there are lumped circuit elements positioned at $\alpha=0$; these lumped circuit elements are referenced as lumped circuit element 961-1, lumped circuit element 962-1, and lumped circuit element 963-1, respectively. Along groove 950-1, lumped circuit element 961-1 is the only lumped circuit element within sector $\sigma_1$; lumped circuit element 961-2 is positioned at the start of sector $\sigma_2$ 910-2. Along groove 950-1, the lumped circuit elements are separated by angular increment $\Delta\alpha_1$.

Along groove 950-2, the lumped circuit elements within sector $\sigma_1$ are lumped circuit element 962-1, lumped circuit element 962-2, and lumped circuit element 962-3; lumped circuit element 962-4 is positioned at the start of sector $\sigma_2$ 910-2. Along groove 950-2, the lumped circuit elements are separated by angular increment $\Delta\alpha_2$ 922.

Along groove 950-3, the lumped circuit elements within sector $\sigma_1$ are lumped circuit element 963-1 and lumped circuit element 963-2; lumped circuit element 963-3 is positioned at the start of sector $\sigma_2$ 910-2. Along groove 950-3, the lumped circuit elements are separated by angular increment $\Delta\alpha_3$ 923.

In the embodiment shown in FIG. 9A and FIG. 9B, the lumped circuit elements are aligned along radial lines and intersect the circular grooves at ninety degrees.

In general, the number of circular grooves, the radius of each circular groove, the number of lumped circuit elements across each circular groove, and the angular increment between lumped circuit elements across each circular groove are user-defined parameters. Note that the angular increments between adjacent lumped circuit elements across a specific circular groove are independently variable. In some embodiments, the angular increments are the same.

Figure 10:
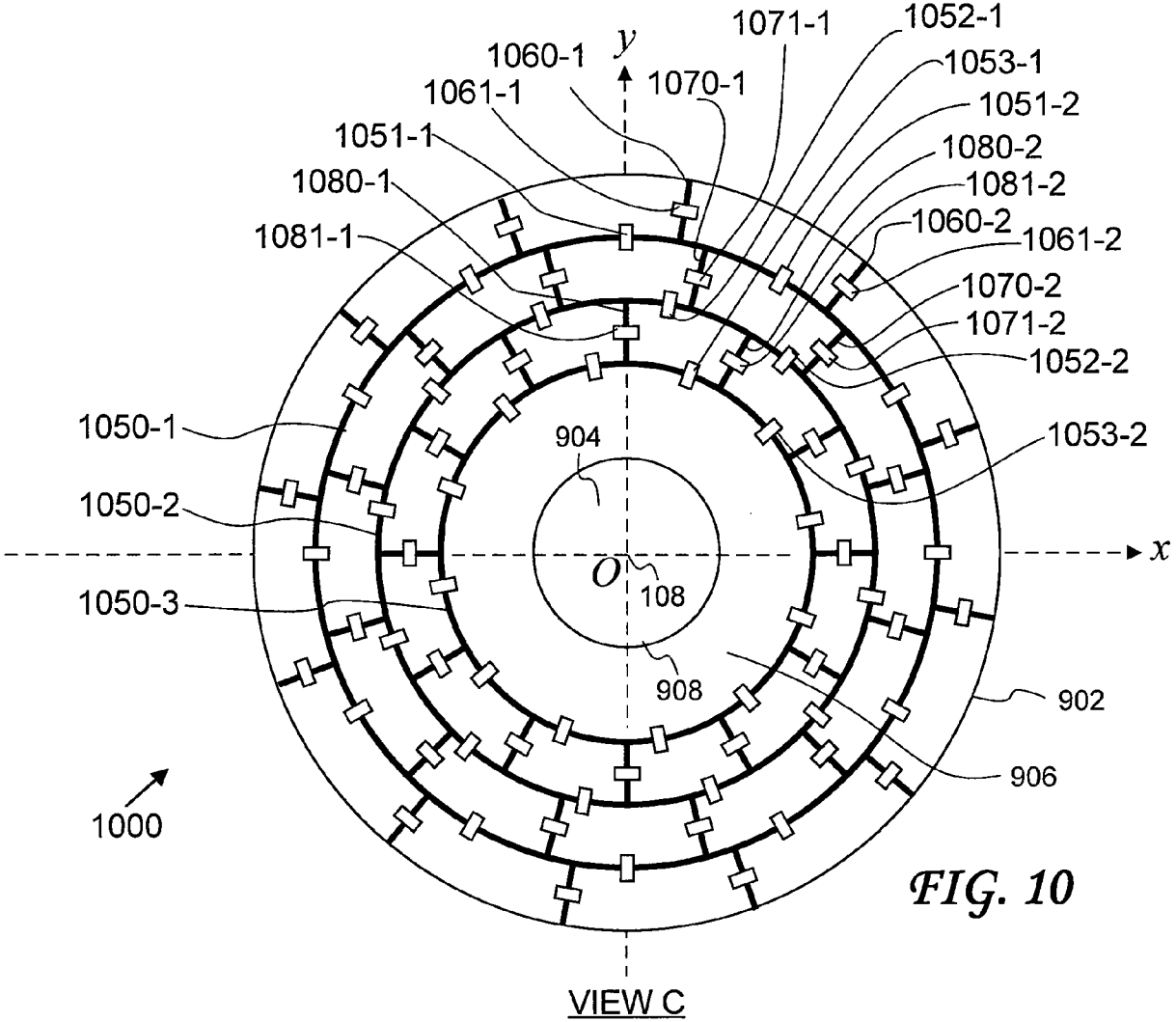
FIG. 10 shows a second embodiment of a semi-transparent ground plane for circularly-polarized radiation.

FIG. 10 (View C) shows another embodiment of a semi-transparent ground plane (referenced as semi-transparent ground plane 1000) configured for circular polarization. Within peripheral region 906 is a first set of grooves configured as a set of concentric circles, labelled circular groove 1050-1, circular groove 1050-2, and circular groove 1050-3. A second set of grooves is configured as a set of radial line segments. Radial grooves 1060-I (I=1 to 12) run from the outer perimeter 902 to circular groove 1050-1. Radial grooves 1070-J (J=1 to 12) run from circular groove 1050-1 to circular groove 1050-2. Radial grooves 1080-K (K=1 to 12) run from circular groove 1050-2 to circular groove 1050-3. To simplify the drawing, not all of the radial grooves are explicitly labelled.

A set of lumped circuit elements is positioned across each circular groove and across each radial groove. Lumped circuit elements 1051-L (L=1 to 12) are positioned across circular groove 1050-1; lumped circuit elements 1052-M (M=1 to 12) are positioned across circular groove 1050-2; and lumped circuit elements 1053-N (N=1 to 12) are positioned across circular groove 1050-3. Lumped circuit element 1061-I is positioned across radial groove 1060-I; lumped circuit element 1071-J is positioned across radial groove 1070-J; and lumped circuit element 1081-K is positioned across radial groove 1080-K. To simplify the drawing, not all of the lumped circuit elements are explicitly labelled.

In the embodiment shown, there is a single lumped circuit element positioned across a radial groove. In other embodiments, multiple lumped circuit elements are positioned across a radial groove; the number of lumped circuit elements can be independently varied for each radial groove. In general, the number and radius of circular grooves, the number and position of radial grooves, and the number and position of lumped circuit elements are user-defined parameters.

Figures 12A, 12B:
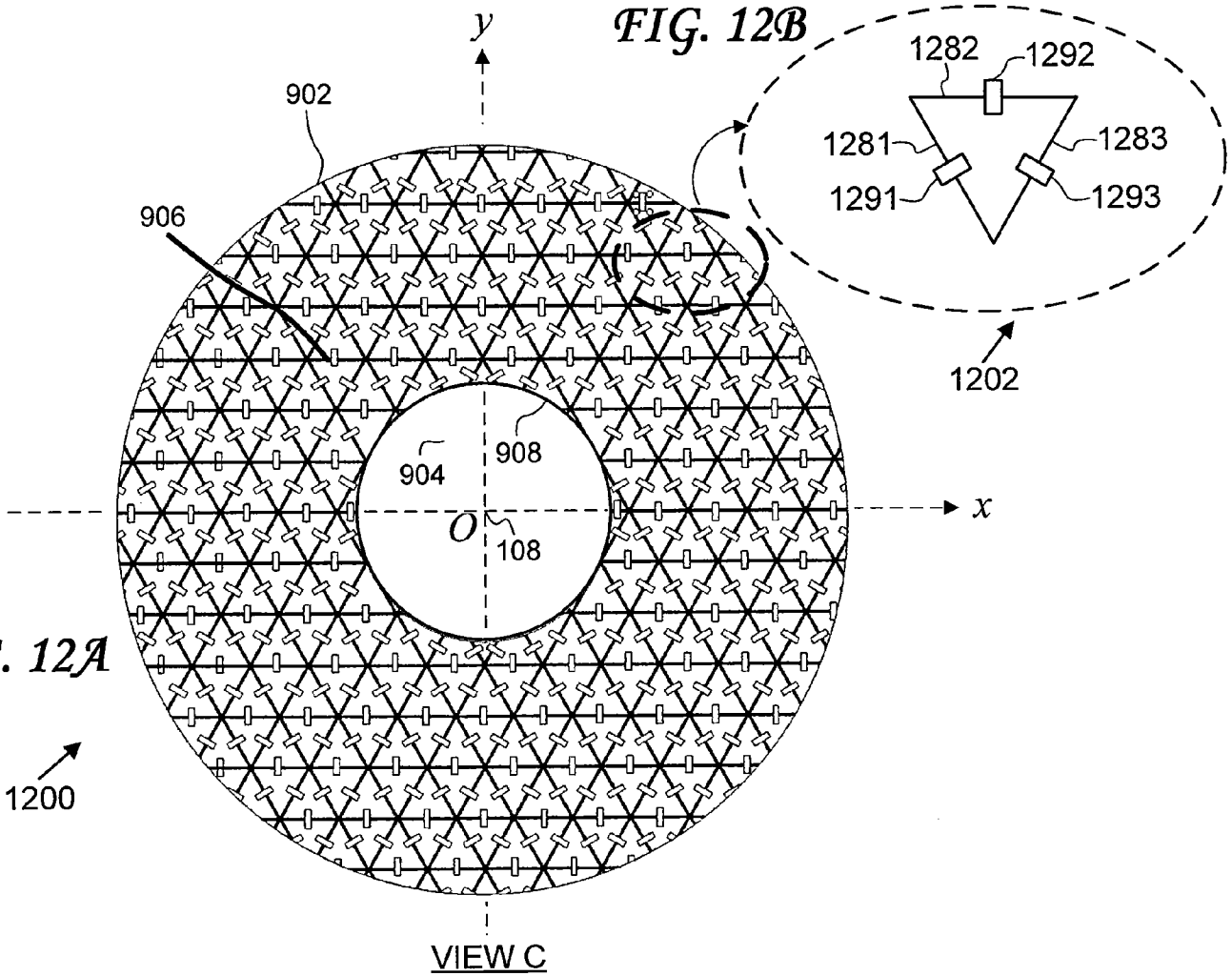
FIG. 12A and FIG. 12B show a fourth embodiment of a semi-transparent ground plane for circularly-polarized radiation.
Figures 13A, 13B:
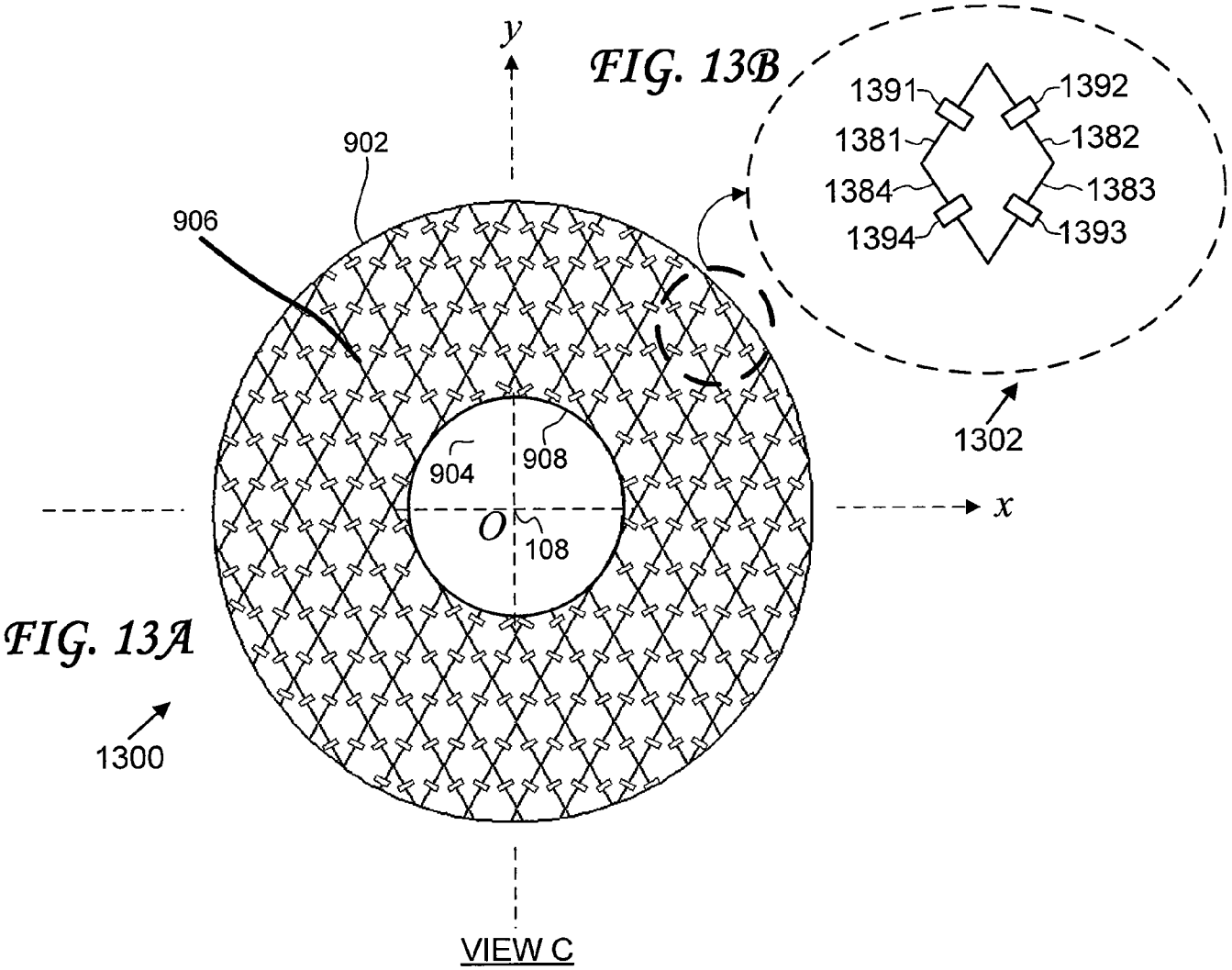
FIG. 13A and FIG. 13B show a fifth embodiment of a semi-transparent ground plane for circularly-polarized radiation.
Figures 14A, 14B:
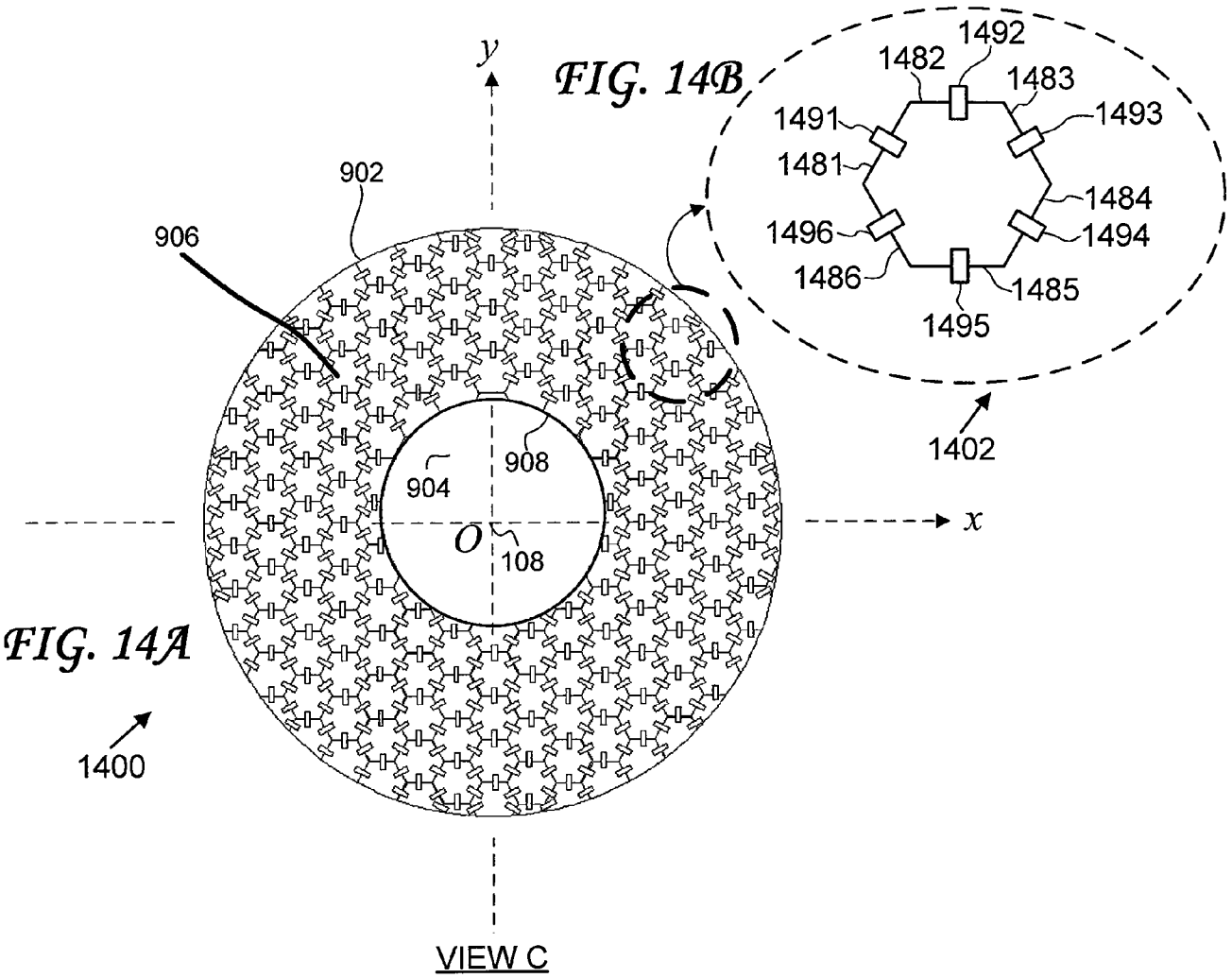
FIG. 14A and FIG. 14B show a sixth embodiment of a semi-transparent ground plane for circularly-polarized radiation.

FIG. 12A, FIG. 13A, and FIG. 14A (all View C) show other embodiments of semi-transparent ground planes configured for circular polarization.

Refer to FIG. 12A. In the peripheral region 906 of ground plane 1200, there are sets of grooves and sets of lumped circuit elements across the grooves. The grooves form an array of equilateral triangles. FIG. 12B shows a close-up view of the details of a single triangle 1202. The three sides of the triangle (labelled side 1281, side 1282, and side 1283) each have a length s. Lumped circuit element 1291 is connected across side 1281; lumped circuit element 1292 is connected across side 1282; and lumped circuit element 1293 is connected across side 1283. In this embodiment, the angle between a lumped circuit element and a groove is ninety degrees. In general, the number of lumped circuit elements across each side is a user-defined parameter.

Refer to FIG. 13A. In the peripheral region 906 of semi-transparent ground plane 1300, there are sets of grooves and sets of lumped circuit elements across the grooves. The grooves form an array of rhombuses. FIG. 13B shows a close-up view of the details of a single rhombus. The four sides of the rhombus (labelled side 1381, side 1382, side 1383, and side 1384) each have a length s. Lumped circuit element 1391 is connected across side 1381; lumped circuit element 1392 is connected across side 1382; lumped circuit element 1393 is connected across side 1383; and lumped circuit element 1394 is connected across side 1384. In this embodiment, the angle between a lumped circuit element and a groove is ninety degrees. In general, the number of lumped circuit elements across each side is a user-defined parameter.

Refer to FIG. 14A. In the peripheral region 906 of semi-transparent ground plane 1400, there are sets of grooves and sets of lumped circuit elements across the grooves. The grooves form an array of regular hexagons. FIG. 14B shows a close-up view of the details of a single hexagon. The six sides of the hexagon (labelled side 1481-side 1486) each have a length s. Lumped circuit element 1491-lumped circuit element 1496 are connected across side 1481-side 1486, respectively. In this embodiment, the angle between a lumped circuit element and a groove is ninety degrees. In general, the number of lumped circuit elements across each side is a user-defined parameter.

In FIG. 12A, FIG. 12B, and FIG. 12C, each groove can be defined by two end points. Each end point is either a locus on the outer perimeter, a locus on the inner perimeter, or a locus within the peripheral region. An end point cannot lie within the central region.

In FIG. 12A, FIG. 12B, and FIG. 12C, the outer perimeter has a circular geometry, and the inner perimeter has a circular geometry. In general, the outer perimeter and the inner perimeter can have different geometries. For example, the outer perimeter can have a circular geometry, and the inner perimeter can have a square geometry (as shown in FIG. 3A). As another example, the outer perimeter can have a rectangular geometry, and the inner perimeter can have a circular geometry (as shown in FIG. 5A).

Figure 11A:
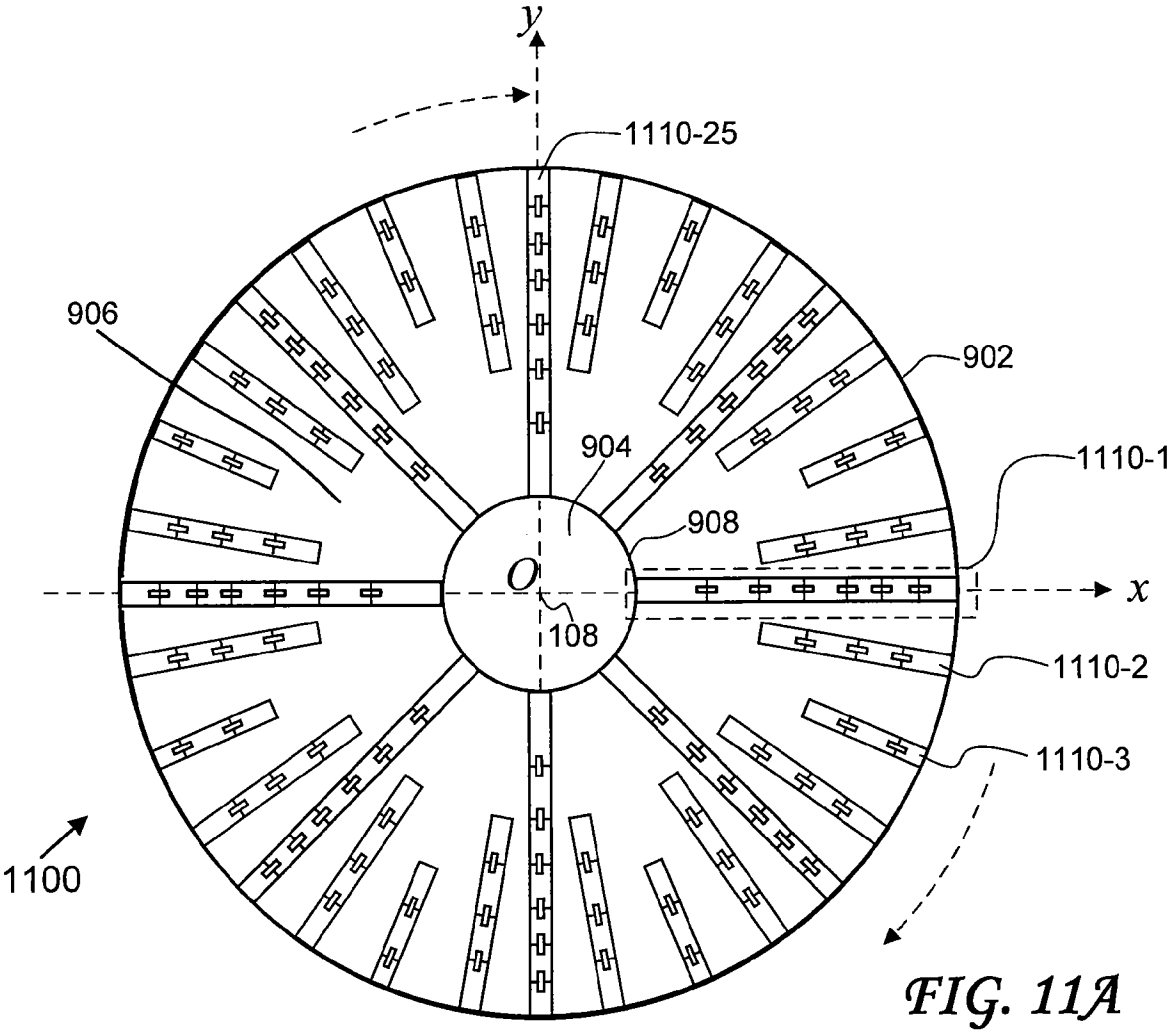
FIG. 11A-FIG. 11C show a third embodiment of a semi-transparent ground plane for circularly-polarized radiation.

FIG. 11A (View C) shows another embodiment of a semi-transparent ground plane (referenced as semi-transparent ground plane 1100) configured for circular polarization. The central region 904 has a continuous conductive layer disposed on an insulating layer. The peripheral region 906 has a set of conductive strips, labelled 1110-1 through 1110-25, disposed on the insulating layer. In the embodiment shown, the conductive strips are oriented along radial lines. In general, the number of conductive strips is a user-defined parameter; and the position, orientation, length, and width of each conductive strip are user-defined parameters that can be independently specified for each conductive strip. In general, the geometry and dimensions of each conductive strip can be independently specified for each conductive strip. Across the width of each conductive strip are one or more grooves; the number of grooves is a user-defined parameter. Across each groove is a lumped circuit element. In general, more than one lumped circuit element can be positioned across a groove; the number of lumped circuit elements is a user-defined parameter. In a minimal configuration, peripheral region 906 contains a single conductive strip, in electrical contact with central region 904, with a single groove and a single lumped circuit element.

Figure 11B:
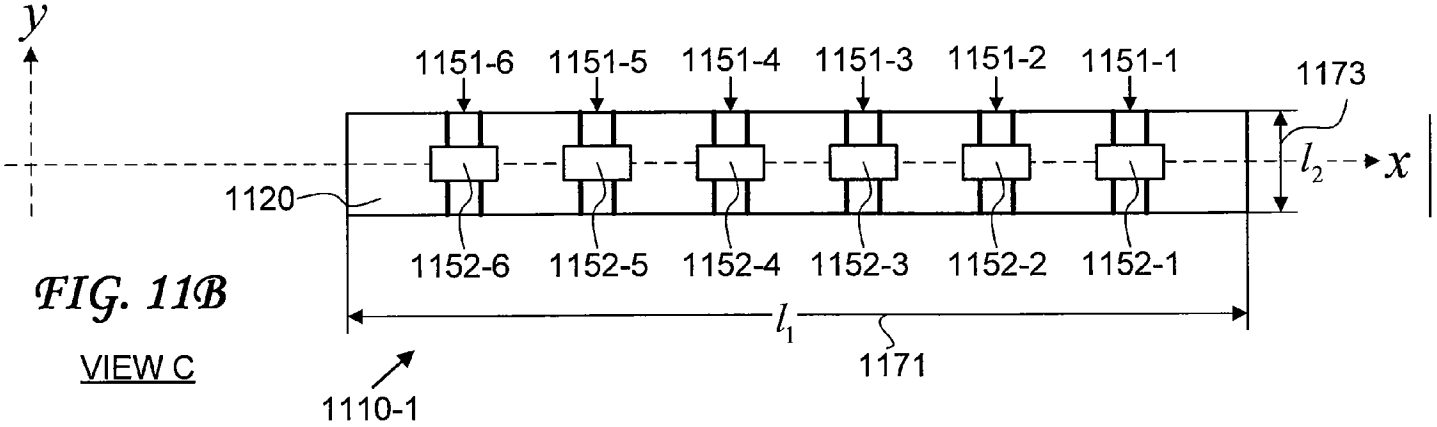
Figure 11C:
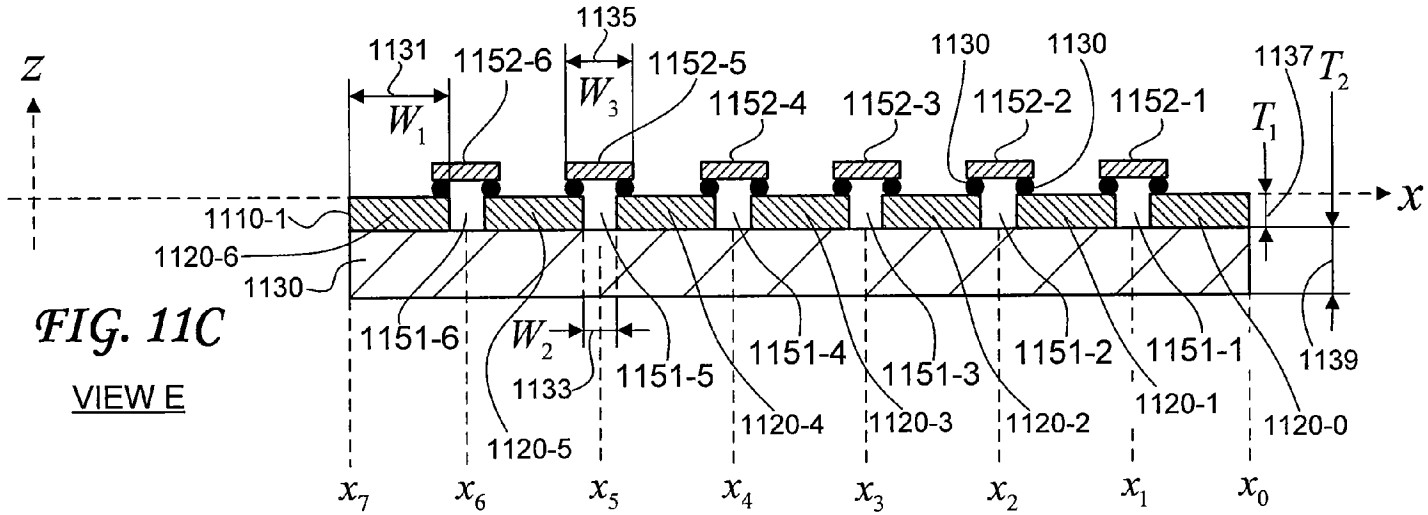

FIG. 11B (View C) and FIG. 11C (View E) show details of a representative conductive strip, conductive strip 1110-1. Refer to FIG. 11B. Conductive strip 1110-1 has a length $l_1$ 1171 along the x-axis and a width $l_2$ 1173 along the y-axis. Across the width of conductive strip 1110-1 are a set of six grooves, labelled groove 1151-1 through groove 1151-6. Across each groove is a lumped circuit element, labelled lumped circuit element 1152-1 through lumped circuit element 1152-6, respectively.

Refer to FIG. 11C. Conductive strip 1110-1 is disposed on an insulating layer 1130; in an embodiment, insulating layer 1130 is a dielectric substrate. The thickness of conductive strip 1110-1 is $T_1$ 1137. The thickness of insulating layer 1130 is $T_2$ 1139. The centerlines of groove 1151-1 through 1151-6 are located at $x=(x_1, x_2, x_3, x_4, x_5, x_6)$, respectively. For reference, the outer edge is located at $x=x_0$, and the inner edge is located at $x=x_7$.

The grooves partition conductive strip 1110-1 into a set of seven conductive segments. The conductive segments are labelled conductive segment 1120-0 through conductive segment 1120-6. The length of a conductive segment is $W_1$ 1131. In the embodiment shown, the lengths of the conductive segments are the same. In general, the lengths of the conductive segments can vary. The width of a groove is $W_2$ 1133. In the embodiment shown, the widths of the grooves are the same. In general, the widths of the grooves can vary. A lumped circuit element is electrically connected across a groove. The length of a lumped circuit element is $W_3$ 1135. For example, lumped circuit element 1152-2 is electrically connected to conductive segment 1120-2 and conductive segment 1120-1 by electrical connections 1130.

Figure 17:
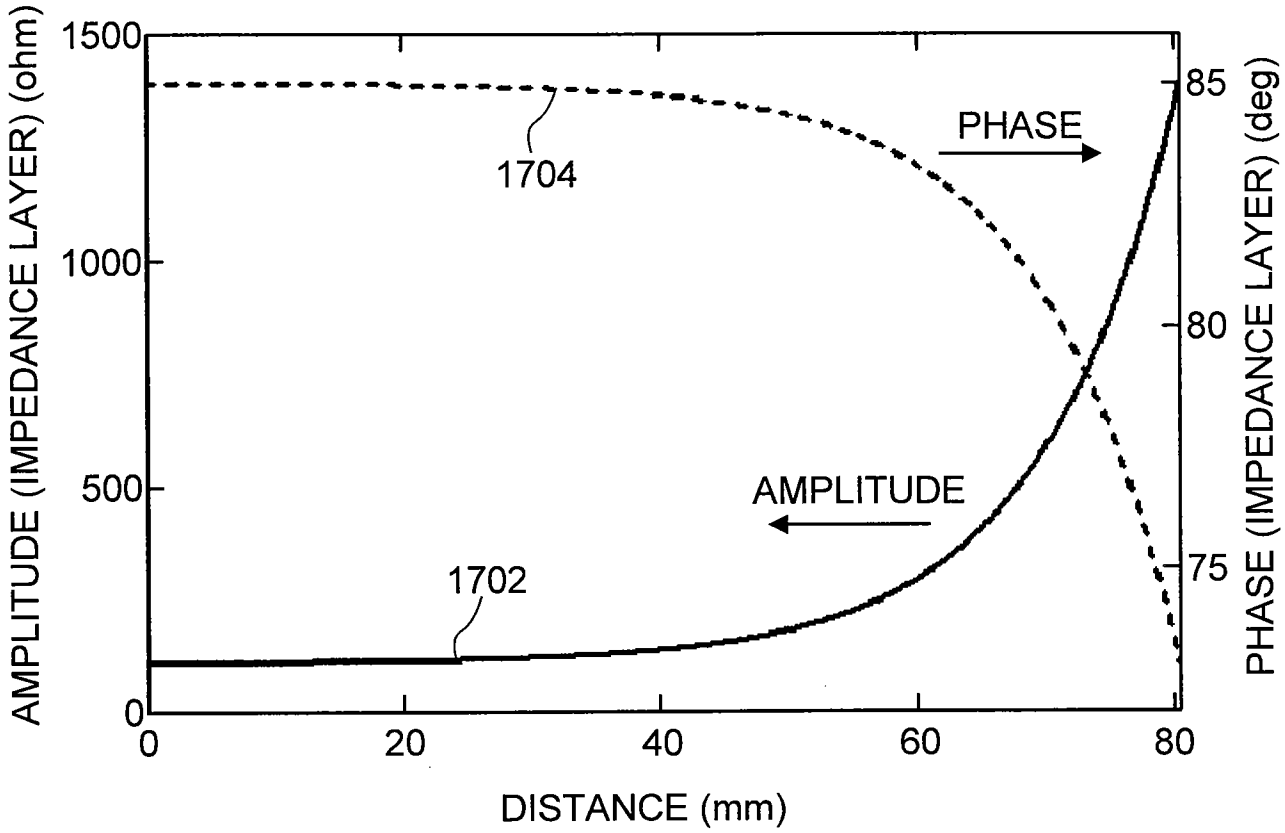
FIG. 17 shows plots of modulus and phase of an impedance layer as a function of distance.

In FIG. 17, plot 1702 is a plot of the modulus (amplitude) distribution and plot 1704 is a plot of the phase distribution of the average layer impedance on a semi-transparent ground plane according to an embodiment of the invention. The values are determined in the absence a radiator. The horizontal axis represents the distance (in mm) from the center of the ground plane. With this distribution, over the Global Positioning System (GPS) L1, L2, and L5 frequency bands, the down/up ratio is less than −20 dB for elevation angles from 30 up to 90 degrees above the semi-transparent ground plane.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A ground plane comprising:

an insulating layer having an outer perimeter;

a conductive layer disposed on the insulating layer, wherein the conductive layer has a thickness (7) and an outer perimeter coincident with the outer perimeter of the insulating layer such that a first plurality of edges associated with the conductive layer are substantially aligned with a second plurality of edges associated with the insulating layer, comprising:

a central region consisting of the region of the conductive layer within an inner perimeter; and a peripheral region consisting of the region of the conductive layer between the inner perimeter and the outer perimeter;

at least one groove of a plurality of grooves in the conductive layer, each groove of the plurality of grooves having a thickness equal to the thickness (T) of the conductive layer and wherein the at least one groove:

has a first end point at a first locus on the outer perimeter, a first locus on the inner perimeter, or a first locus within the peripheral region; and has a second end point at a second locus on the outer perimeter, a second locus on the inner perimeter, or a second locus within the peripheral region; and at least one lumped circuit element disposed within the at least one groove and electromagnetically coupled at a first point on the lumped circuit element to a portion of the conductive layer on one side of the groove at a second point on the conductive layer, and electromagnetically coupled at a third point on the lumped circuit element to a portion of the conductive layer on the opposite side of the groove at a fourth point on the conductive layer, such that the first point and the third point of the electromagnetic coupling are positioned within the at least one groove at a position that is more proximal to the insulating layer than the second point and the fourth point on the conductive layer.

2. The ground plane of claim 1, wherein:

the lumped circuit element is one of a plurality of lumped circuit elements electromagnetically coupled to a portion of the conductive layer on one side of the groove to a portion of the conductive layer on the opposite side of the groove.

3. The ground plane of claim 1, wherein the lumped circuit element comprises at least one of a resistor, a capacitor, or an inductor.

4. The ground plane of claim 1, further comprising:

for each groove in the plurality of grooves, at least one lumped circuit element electromagnetically coupled to a portion of the conductive layer on one side of the groove to a portion of the conductive layer on the other side of the groove.

5. The ground plane of claim 1, wherein the plurality of grooves is configured as a geometrical array of grooves.

6. The ground plane of claim 5, wherein the geometrical array comprises one of:

a geometrical array of rectangles;

a geometrical array of rhombuses;

a geometrical array of triangles; or a geometrical array of hexagons.

7. The ground plane of claim 1, wherein:

the insulating layer comprises a dielectric substrate; and the conductive layer comprises a metal film.

8. An antenna system comprising:

an antenna comprising:

a radiator element; and a ground element; and a ground plane comprising:

an insulating layer having an outer perimeter;

a conductive layer disposed on the insulating layer, wherein the conductive layer has a thickness (7) and has an outer perimeter coincident with the outer perimeter of the insulating layer such that a first plurality of edges associated with the conductive layer are substantially aligned with a second plurality of edges associated with the insulating layer, comprising:

a central region consisting of the region of the conductive layer within an inner perimeter; and a peripheral region consisting of the region of the conductive layer between the inner perimeter and the outer perimeter;

at least one groove of a plurality of grooves in the conductive layer, each groove of the plurality of grooves having a thickness equal to the thickness (T) of the conductive layer and wherein the at least one groove:

has a first end point at a first locus on the outer perimeter, a first locus on the inner perimeter, or a first locus within the peripheral region; and has a second end point at a second locus on the outer perimeter, a second locus on the inner perimeter, or a second locus within the peripheral region; and at least one lumped circuit element disposed within the at least one groove and electromagnetically coupled at a first point on the lumped circuit element to a portion of the conductive layer on one side of the groove at a second point on the conductive layer, and electromagnetically coupled at a third point on the lumped circuit element to a portion of the conductive layer on the opposite side of the groove at a fourth point on the conductive layer, such that the first point and the third point of the electromagnetic coupling are positioned within the at least one groove at a position that is more proximal to the insulating layer than the second point and the fourth point on the conductive layer;

wherein the ground element is disposed on the central region.

9. The antenna system of claim 8, wherein:

the lumped circuit element is one of a plurality of lumped circuit elements electromagnetically coupled to a portion of the conductive layer on one side of the groove to a portion of the conductive layer on the opposite side of the groove.

10. The antenna system of claim 8, wherein the lumped circuit element comprises at least one of a resistor, a capacitor, or an inductor.

11. The antenna system of claim 8 wherein the ground plane further comprises:

for each groove in the plurality of grooves, at least one lumped circuit element electromagnetically coupled to a portion of the conductive layer on one side of the groove to a portion of the conductive layer on the other side of the groove.

12. The antenna system of claim 8, wherein the plurality of grooves is configured as a geometrical array of grooves.

13. The antenna system of claim 8, wherein:

the insulating layer comprises a dielectric substrate; and the conductive layer comprises a metal film.

* * * * *